US008220531B2

(12) United States Patent
Murakami et al.

(10) Patent No.: US 8,220,531 B2
(45) Date of Patent: Jul. 17, 2012

(54) HEAT PUMP SYSTEM WITH AUXILIARY WATER HEATING

(75) Inventors: Toshio Murakami, San Paulo (BR); Carlos A. Tesche, Canoas (BR); Roberto G. Fernandez, Canoas (BR)

(73) Assignee: Carrier Corporation, Farmington, CT (US)

( * ) Notice: Subject to any disclaimer, the term of this patent is extended or adjusted under 35 U.S.C. 154(b) by 1189 days.

(21) Appl. No.: 11/630,081

(22) PCT Filed: Jun. 3, 2005

(86) PCT No.: PCT/BR2005/000097

§ 371 (c)(1),
(2), (4) Date: Jan. 3, 2008

(87) PCT Pub. No.: WO2006/128262

PCT Pub. Date: Dec. 7, 2006

(65) Prior Publication Data

US 2008/0190130 A1 Aug. 14, 2008

(51) Int. Cl.
*F25B 29/00* (2006.01)
*F25B 13/00* (2006.01)
*G05D 9/00* (2006.01)

(52) U.S. Cl. ..... 165/240; 165/301; 62/324.1; 62/324.6

(58) Field of Classification Search ..... 165/240, 165/299, 300, 301; 62/324.1, 324.6
See application file for complete search history.

(56) References Cited

U.S. PATENT DOCUMENTS 3,177,674 A 4/1965 Spofford
3,188,829 A 6/1965 Siewert et al.
3,301,002 A 1/1967 McGrath
4,098,092 A 7/1978 Singh
4,134,274 A 1/1979 Johnsen
4,238,933 A 12/1980 Coombs
4,249,390 A 2/1981 Jones
4,299,098 A 11/1981 Derosier
4,399,664 A 8/1983 Derosier
4,409,796 A 10/1983 Fisher
4,492,092 A 1/1985 Smorol et al.
4,493,193 A 1/1985 Fisher
(Continued)

OTHER PUBLICATIONS

Notification of Transmittal of International Preliminary Report on Patentability—PCT/BR05/00097 mailed Sep. 25, 2007, 6 pages.

*Primary Examiner* — Ljiljana Ciric
(74) *Attorney, Agent, or Firm* — Cantor Colburn LLP

(57) ABSTRACT

A heat pump system (10) includes a compressor (20), a reversing valve (30), an outdoor heat exchanger (40) and an indoor heat exchanger (50) coupled via refrigerant lines (35, 45, 55) in a conventional refrigeration circuit, and a refrigerant-to-water heat exchanger (60). In the air cooling with water heating mode, the air heating with water heating mode and the water heating only mode, water from a water reservoir (64), such as a storage tank or swimming pool, is passed through heat exchanger (60) in heat exchange relationship with refrigerant passing through line (35). A refrigerant reservoir (70) may be provided for use in refrigerant charge control. A refrigerant line (71) couples reservoir (70) to the refrigerant circuit intermediate the outdoor and indoor heat exchangers for directing liquid refrigerant into the reservoir (70) and a refrigerant line (73) couples the refrigerant circuit upstream of the suction inlet to the compressor (20) for returning refrigerant to the refrigerant circuit. A controller (100) controls flow into and from the refrigerant reservoir (70) through selective opening and closing of control valve (72) in line (71) and control valve (74) in line (73).

17 Claims, 12 Drawing Sheets

U.S. PATENT DOCUMENTS

| | | | | |
|---|---|---|---|---|
| 4,528,822 | A | 7/1985 | Glamm | |
| 4,598,557 | A | 7/1986 | Robinson et al. | |
| 4,646,537 | A | 3/1987 | Crawford | |
| 4,766,734 | A | 8/1988 | Dudley | |
| 4,940,079 | A | 7/1990 | Best et al. | |
| 5,184,472 | A | 2/1993 | Guilbault et al. | |
| 5,211,029 | A | 5/1993 | Uselton et al. | |
| 5,269,153 | A | 12/1993 | Cawley | |
| 5,465,588 | A | 11/1995 | McCahill et al. | |
| 5,467,812 | A | 11/1995 | Dean et al. | |
| 5,495,723 | A | 3/1996 | MacDonald et al. | |
| 5,653,120 | A | 8/1997 | Meyer | |
| 5,802,864 | A | 9/1998 | Yarbrough et al. | |
| 5,901,563 | A | 5/1999 | Yarbrough et al. | |
| 6,253,564 | B1 | 7/2001 | Yarbrough et al. | |
| 6,286,322 | B1 | 9/2001 | Vogel et al. | |
| 6,615,602 | B2 | 9/2003 | Wilkinson | |
| 7,162,878 | B2 * | 1/2007 | Narayanamurthy et al. | 62/434 |
| 7,290,600 | B2 * | 11/2007 | Gavula | 165/299 |
| 7,363,772 | B2 * | 4/2008 | Narayanamurthy | 62/435 |
| 7,503,185 | B2 * | 3/2009 | Narayanamurthy et al. | 62/332 |
| 7,757,508 | B2 * | 7/2010 | Ally et al. | 62/238.6 |
| 7,793,515 | B2 * | 9/2010 | Narayanamurthy | 62/434 |
| 7,802,441 | B2 * | 9/2010 | Seefeldt | 62/238.7 |
| 7,849,700 | B2 * | 12/2010 | Seefeldt | 62/238.6 |
| 7,854,129 | B2 * | 12/2010 | Narayanamurthy | 62/139 |
| 8,037,710 | B2 * | 10/2011 | Wu et al. | 62/324.6 |
| 8,069,682 | B2 * | 12/2011 | Yoshimi et al. | 62/324.1 |
| 8,074,459 | B2 * | 12/2011 | Murakami et al. | 62/324.1 |
| 8,091,377 | B2 * | 1/2012 | Jeong et al. | 62/324.6 |
| 8,099,972 | B2 * | 1/2012 | Dupraz | 62/324.1 |
| 8,109,111 | B2 * | 2/2012 | Yamada | 62/324.1 |

* cited by examiner

HEAT PUMP SYSTEM WITH AUXILIARY WATER HEATING

TECHNICAL FIELD

This invention relates generally to heat pump systems and, more particularly, to heat pump systems including auxiliary liquid heating, including for example heating water for swimming pools, household water systems and the like.

BACKGROUND ART

Reversible heat pumps are well known in the art and commonly used for cooling and heating a climate controlled comfort zone with a residence or a building. A conventional heat pump includes a compressor, a suction accumulator, a reversing valve, an outdoor heat exchanger with an associated fan, an indoor heat exchanger with an associated fan, an expansion valve operatively associated with the outdoor heat exchanger and a second expansion valve operatively associated with the indoor heat exchanger. The aforementioned components are typically arranged in a closed refrigerant circuit pump system employing the well known Carnot vapor compression cycle. When operating in the cooling mode, excess heat absorbed by the refrigerant in passing through the indoor heat exchanger is rejected to the environment as the refrigerant passes through the outdoor heat exchanger.

It is well known in the art that an additional refrigerant-to-water heat exchanger may be added to a heat pump system to absorb this excess heat for the purpose of heating water, rather than simply rejecting the excess heat to the environment. Further, heat pumps often have non-utilized heating capacity when operating in the heating mode for heating the climate controlled zone. For example, each of U.S. Pat. Nos. 3,188,829; 4,098,092; 4,492,092 and 5,184,472 discloses a heat pump system including an auxiliary hot water heat exchanger. However, these systems do not include any device for controlling the refrigerant charge within the refrigerant circuit. Therefore, while functional, these systems would not be optimally efficient in all modes of operation.

In heat pump systems, the outdoor heat exchanger and the indoor heat exchanger each operate as evaporator, condenser or subcooler, depending on the mode and point of operation. As such, condensing may occur in either heat exchangers, and the suction line may be filled with refrigerant in a gaseous or liquid state. As a consequence, the amount of system refrigerant charge required in each mode of operation in order to ensure operation within an acceptable efficiency envelope will be different for each mode.

U.S. Pat. No. 4,528,822 discloses a heat pump system including an additional refrigerant-to-liquid heat exchanger for heating liquid utilizing the heat that would otherwise be rejected to the environment. The system is operable in four independent modes of operation: space heating, space cooling, liquid heating and simultaneous space cooling with liquid heating. In the liquid heating only mode, the indoor heat exchanger fan is turned off, while in the space cooling and liquid heating mode, the outdoor heat exchanger fan is turned off. A refrigerant charge reservoir is provided into which liquid refrigerant drains by gravity from the refrigerant to liquid heat exchanger during the liquid heating only mode and the simultaneous space cooling and liquid heating mode. However, no control procedure is disclosed for actively controlling refrigerant charge in the refrigerant circuit in all modes of operation. Further, no simultaneous space heating and liquid heating mode is disclosed.

Accordingly, it is desirable that the system be provide that includes active refrigerant charge control in all modes of operation whereby the heat pump system may operate effectively in an air cooling only mode, an air cooling and liquid heating mode, an air heating only mode, an air heating and liquid heating mode, and a liquid heating only mode.

SUMMARY OF THE INVENTION

In one aspect, it is an object of the invention to provide a heat pump system having liquid heating capability and improved refrigerant charge control.

In one aspect, it is an object of the invention to provide a heat pump system having liquid heating capability and refrigerant charge control in all operating modes.

In one embodiment of the invention, a heat pump system includes a refrigerant compressor having a suction port and a discharge port; a selectively positionable four-port reversing valve having a first position for coupling the first port and the second port in fluid flow communication and the third port and the fourth port in fluid flow communication, and a second position for coupling the first port and the third port in fluid flow communication and the second port and the fourth port in fluid flow communication; and a refrigerant circuit providing a closed loop refrigerant circulation flow path. The refrigerant circuit has a first refrigerant line establishing a flow path between the discharge port of the compressor and the first port of the reversing valve, a second refrigerant line establishing a flow path between the second port of the reversing valve and the third port of the reversing valve, and a third refrigerant line establishing a flow path between the fourth port of the reversing valve and the suction port of the compressor. An outdoor heat exchanger is disposed in operative association with the second refrigerant line and is adapted for passing refrigerant passing through the second refrigerant line in heat exchange relationship with ambient air. An indoor heat exchanger is disposed in operative association with the second refrigerant line and is adapted for passing refrigerant passing through the second refrigerant line in heat exchange relationship with the air from the comfort zone. The indoor heat exchanger is disposed downstream of the outdoor exchanger with respect to refrigerant flow in the air cooling mode and upstream of the outdoor heat exchanger with respect to refrigerant flow through the second refrigerant line in the air heating mode. A refrigerant to liquid heat exchanger is disposed in operative association with the first refrigerant line and is adapted for passing refrigerant passing through the first refrigerant line in heat exchange relationship with a liquid. A refrigerant reservoir is provided having an inlet coupled through a fourth refrigerant line in fluid flow communication to the second refrigerant line at a location intermediate the outdoor heat exchanger and the indoor heat exchanger and an outlet coupled through a fifth refrigerant line in fluid flow communication to the third refrigerant line.

In another embodiment of the invention, a heat pump system includes a refrigerant compressor having a suction port and a discharge port; a first selectively positionable four-port valve having a first position for coupling the first port and the second port in fluid flow communication and the third port and the fourth port in fluid flow communication, and a second position for coupling the first port and the third port in fluid flow communication and the second port and the fourth port in fluid flow communication; and a refrigerant circuit providing a closed loop refrigerant circulation flow path. The refrigerant circuit has a first refrigerant line establishing a flow path between the discharge port of the compressor and the first port of the reversing valve, a second refrigerant line establishing a flow path between the second port of the reversing valve and the third port of the reversing valve, and a third refrigerant line establishing a flow path between the fourth port of the reversing valve and the suction port of the compressor. An outdoor heat exchanger is disposed in operative association with the second refrigerant line and is adapted for passing refrigerant passing through the second refrigerant line in heat exchange relationship with ambient air. An indoor heat exchanger is disposed inoperative association with the second refrigerant line and is adapted for passing refrigerant passing through the second refrigerant line in heat exchange relationship with the air from the comfort zone. The indoor heat exchanger is disposed downstream of the outdoor exchanger with respect to refrigerant flow in the air cooling mode and upstream of the outdoor heat exchanger with respect to refrigerant flow through the second refrigerant line in the air heating mode. A refrigerant to liquid heat exchanger is disposed in operative association with the first refrigerant line and is adapted for passing refrigerant passing through the first refrigerant line in heat exchange relationship with a liquid. In this embodiment, a second selectively positionable four-port valve is provide having a first position for coupling the first port and the second port in fluid flow communication and the third port and the fourth port in fluid flow communication and a second position for coupling the first port and the third port in fluid flow communication and the second port and the fourth port in fluid flow communication. This second four-port valve is disposed in the second refrigerant line with the first port in flow communication with the indoor heat exchanger and the second port in flow communication with the third port of the first four-port valve. A refrigerant reservoir is provided having an inlet coupled through a fourth refrigerant line in fluid flow communication to the second refrigerant line at a location intermediate the outdoor heat exchanger and the indoor heat exchanger and an outlet coupled through a fifth refrigerant line in fluid flow communication to the third refrigerant line. A bypass bleed flow circuit is included having a first bleed line coupled in flow communication between the fifth refrigerant line and the third port of the second selectively positionable valve and a second bleed line coupled in flow communication between the indoor heat exchanger and the fourth port of the second selectively positionable valve.

In either of the afore-mentioned embodiments, it is particularly advantageous to include a first flow control valve having an open position and a closed position is disposed in the fourth refrigerant line for controlling the flow of refrigerant from the second refrigerant line to the inlet of the refrigerant reservoir; a second flow control valve having an open position and a closed position is disposed in the fifth refrigerant line for controlling the flow refrigerant between the outlet of refrigerant reservoir and the third refrigerant line, and a controller selectively controls the respective positioning of the first and second flow control valves between their respective open and closed positions so as to selectively control the refrigerant charge within the refrigerant circuit. The first and second flow control valves may also have at least one partially open position and may comprise pulse width modulated solenoid valves. The controller may be further operative to selectively modulate the respective positioning of the flow control valves between their open, partially open and closed positions.

In a further embodiment, a liquid level sensor is provided for sensing the level of liquid refrigerant in the refrigerant reservoir and for providing a signal to the controller indicative of the liquid level within the refrigerant reservoir. In response to the liquid level signal, the controller will selectively control the respective positioning of the first and second flow control valves so as to selectively control the refrigerant charge within the refrigerant circuit.

A first expansion valve being operatively associated with the indoor heat exchanger and a second expansion valve being operatively associated with the outdoor heat exchanger may be disposed in the second refrigerant line, with the first expansion valve disposed intermediate the outdoor heat exchanger and the location the inlet of the refrigerant reservoir is coupled in fluid flow communication with the second refrigerant line, and the second expansion valve disposed intermediate the indoor heat exchanger and the location the inlet of the refrigerant reservoir is coupled in fluid flow communication with the second refrigerant line. A first expansion valve bypass line operatively associated with the second refrigerant line provides for bypassing refrigerant passing through the second refrigerant line in a direction from the outdoor heat exchanger to the indoor heat exchanger around the first expansion valve and through said second expansion valve. A second expansion valve bypass line operatively associated with the second refrigerant line provides for bypassing refrigerant passing through the second refrigerant line in a direction from the indoor heat exchanger to the outdoor heat exchanger around the second expansion valve and through the first expansion valve.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 4:
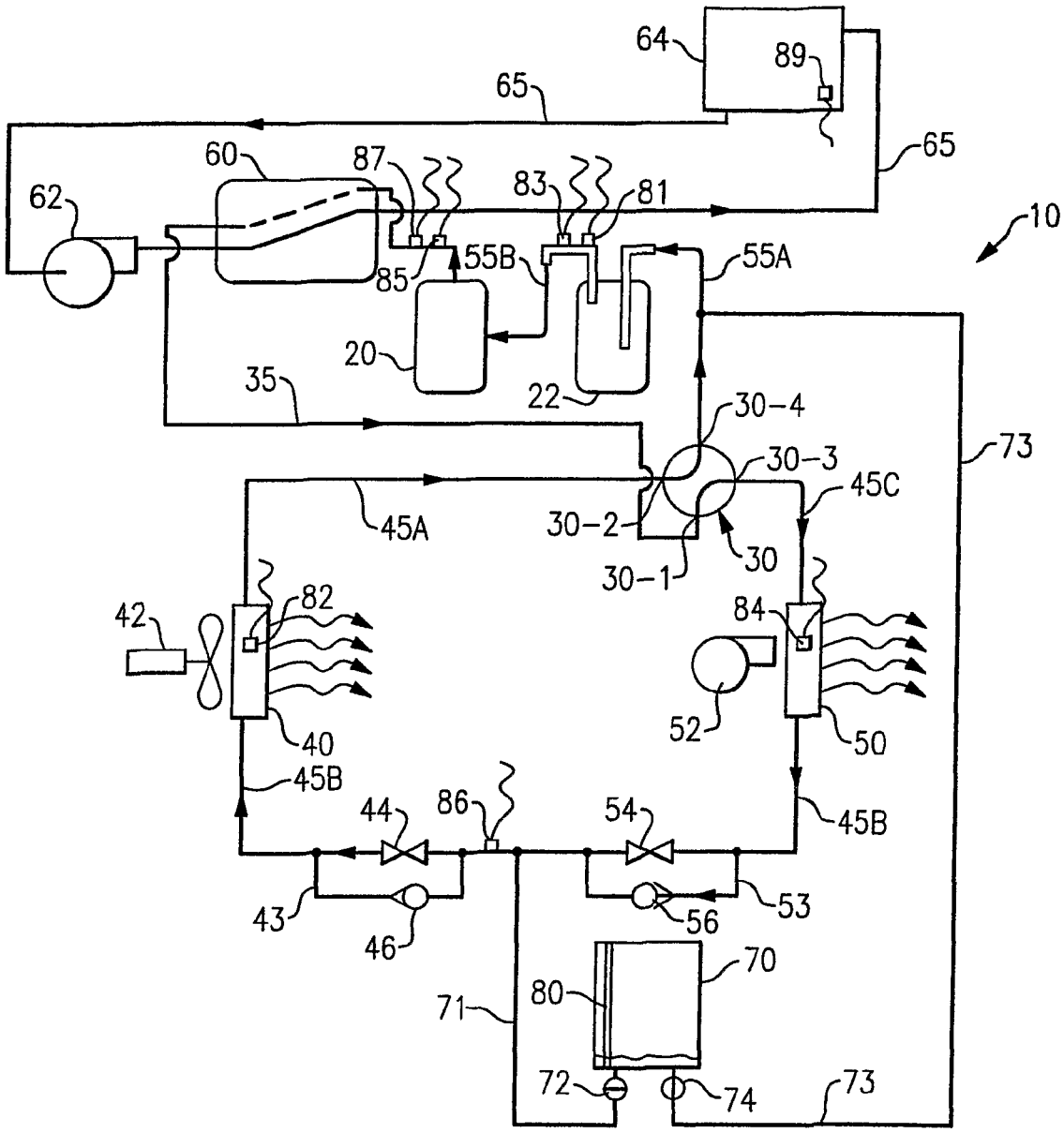
FIG. 4 is a schematic diagram illustrating a first embodiment of the heat pump system of the invention illustrating operation in the indoor air heating with water heating mode.
Figure 5:
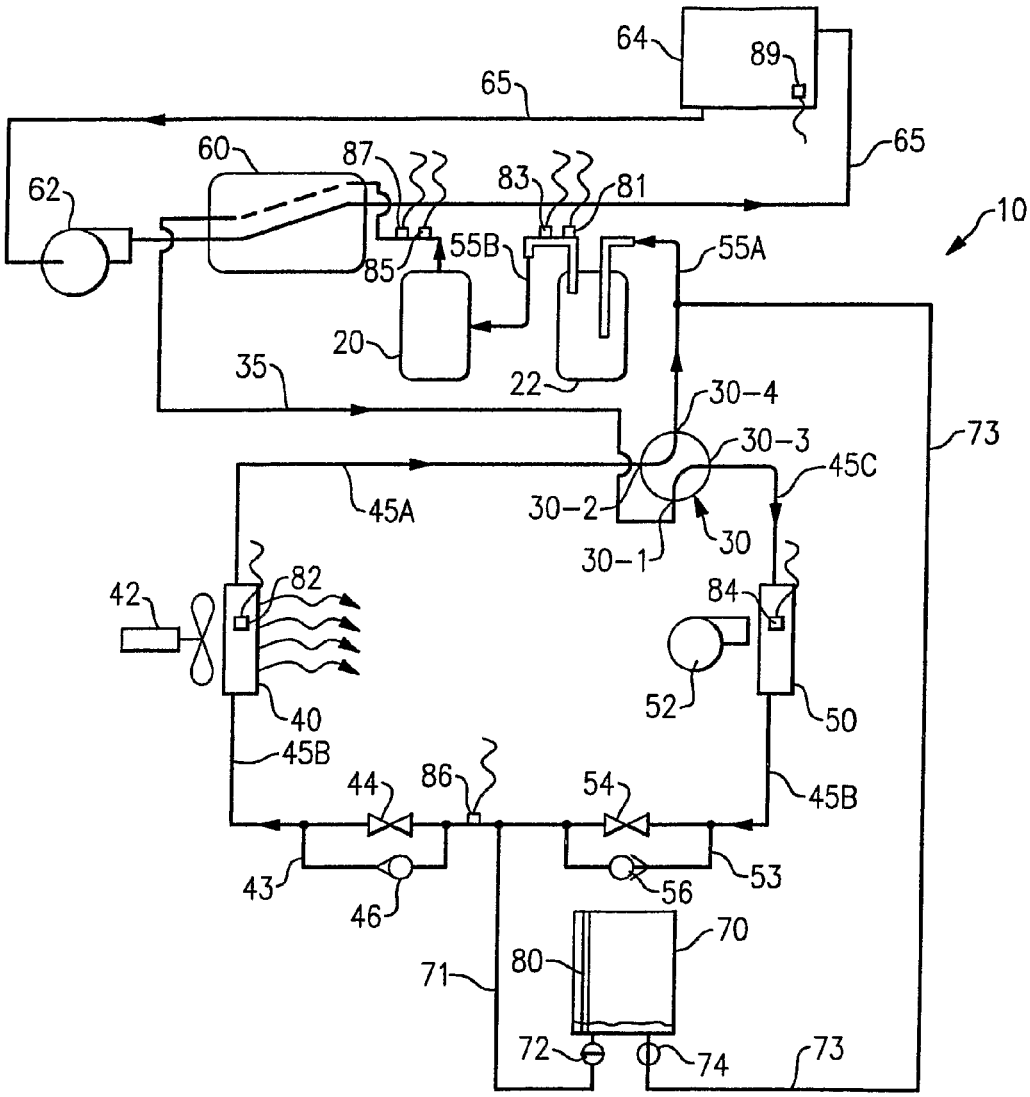
FIG. 5 is a schematic diagram illustrating a first embodiment of the heat pump system of the invention illustrating operation in the water heating only mode.
Figure 6:
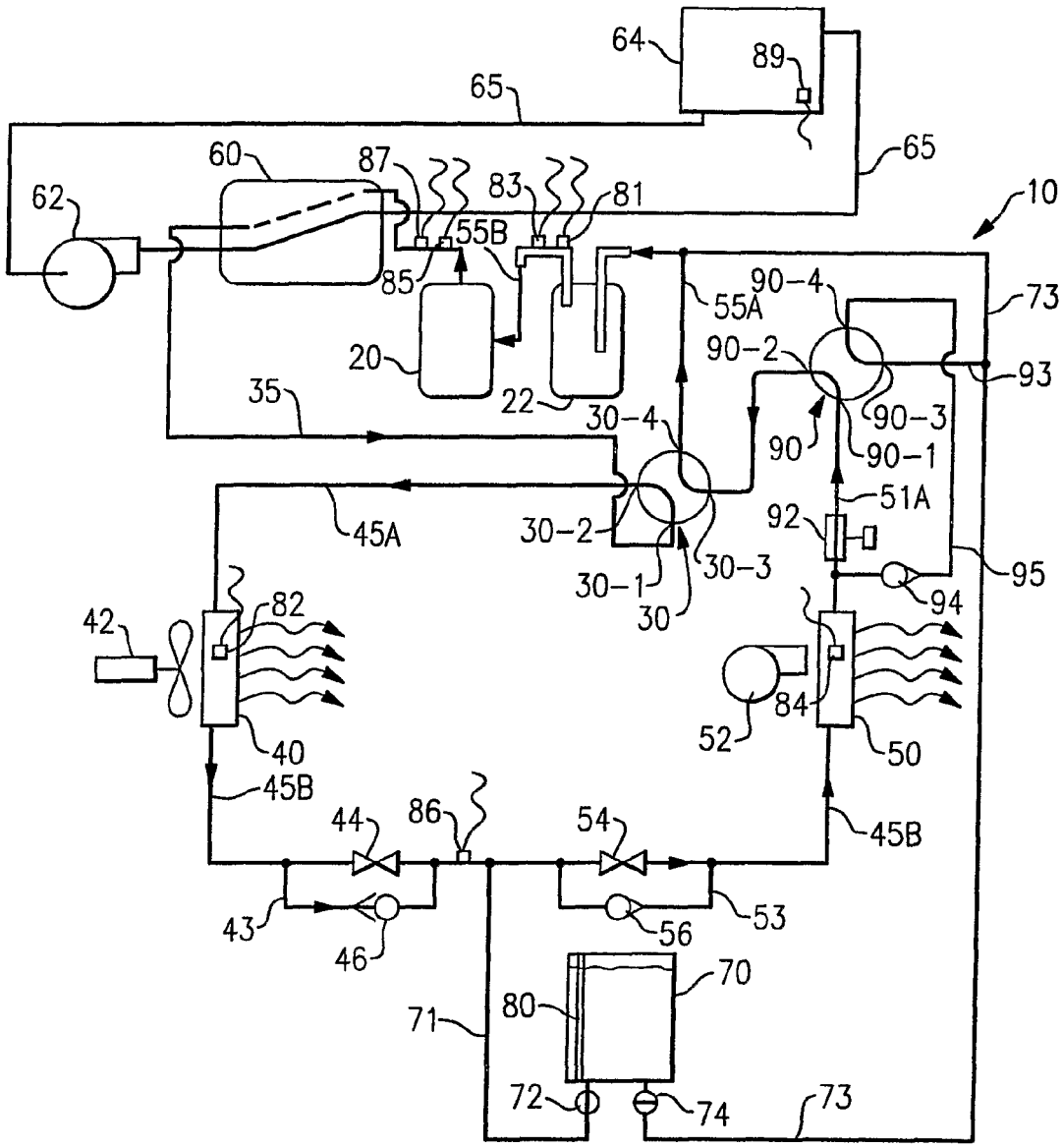
FIG. 6 is a schematic diagram illustrating a second embodiment of the heat pump system of the invention illustrating operation in an air cooling mode.
Figure 7:
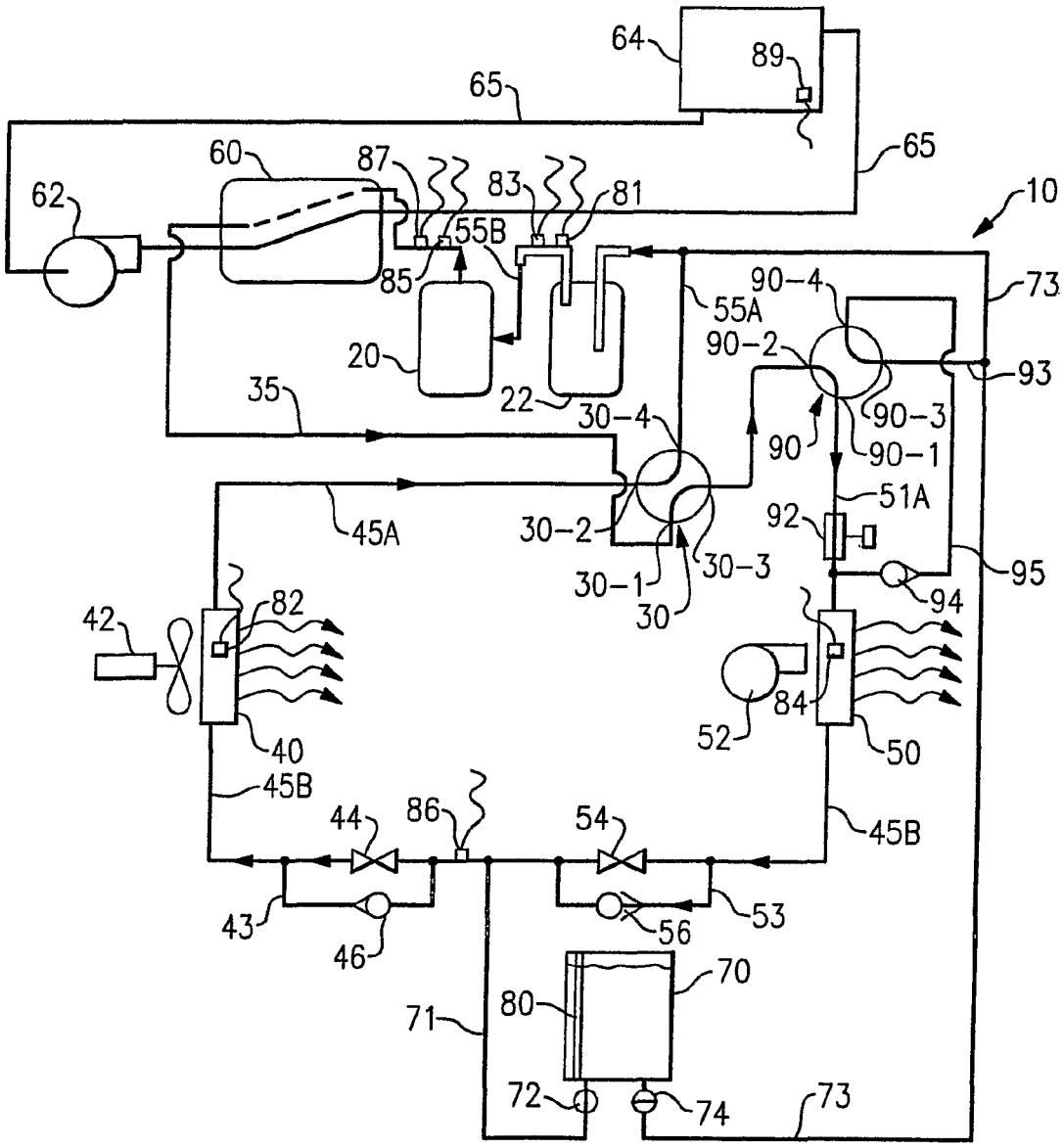
FIG. 7 is a schematic diagram illustrating a second embodiment of the heat pump system of the invention illustrating operation in a first air heating mode.
Figure 8:
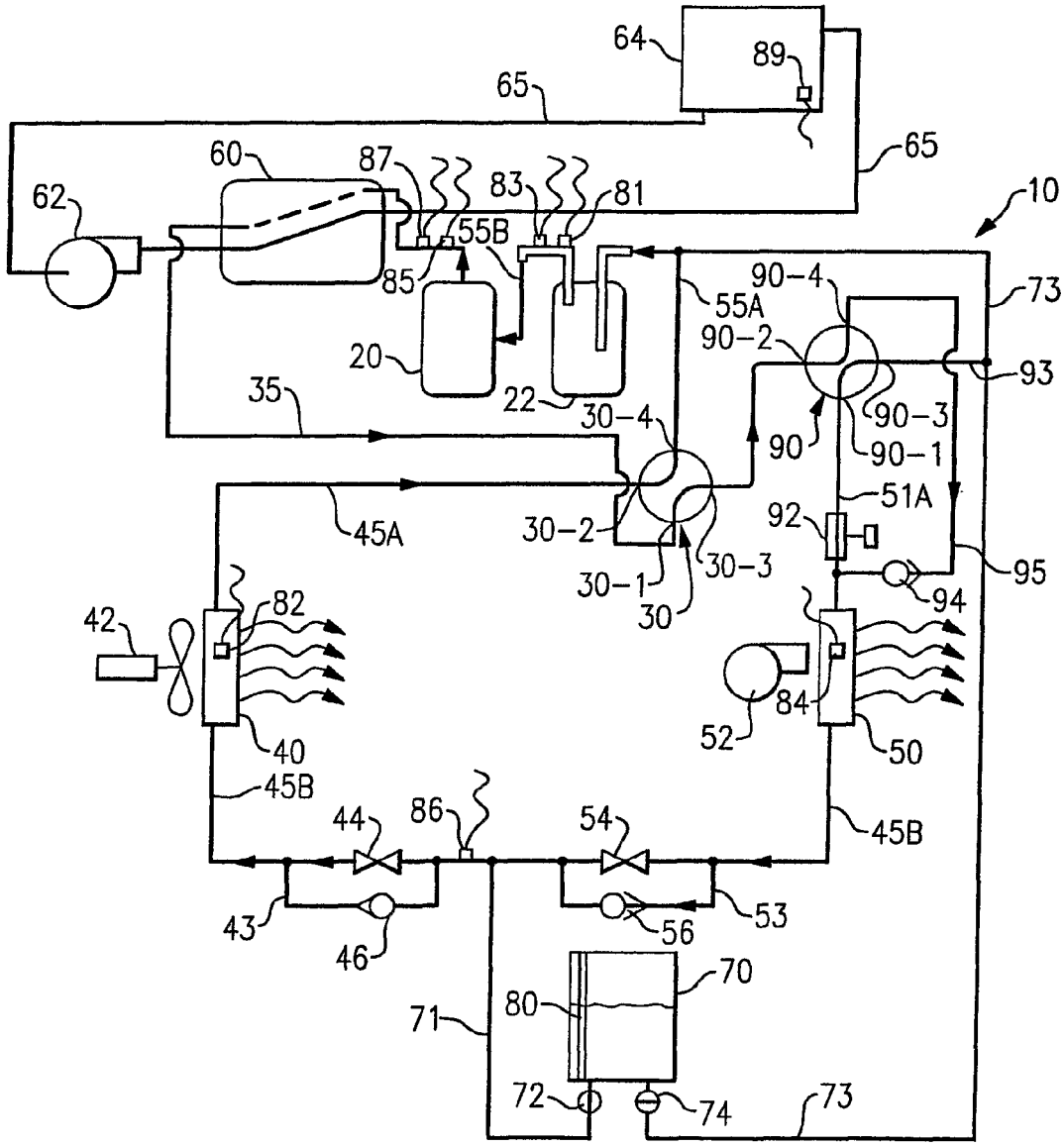
FIG. 8 is a schematic diagram illustrating a second embodiment of the heat pump system of the invention illustrating operation in a second air heating mode.

The refrigerant heat pump system 10, depicted in a first embodiment in FIGS. 1-5 and a second embodiment in FIGS. 6-8, provides not only either heating or cooling air to a comfort region, for example an indoor zone located on the inside of a building (not shown), but also auxiliary water heating. The system includes a compressor 20, a suction accumulator 22, a reversing valve 30, an outdoor heat exchanger 40 and associated fan 42 located on the outside of the building in heat transfer relation with the surrounding ambient, an indoor heat exchanger 50 and associated fan 52 situated in the comfort zone, a first expansion valve 44 operatively associated with the outdoor heat exchanger 40 and a second expansion valve 54 operatively associated with the indoor heat exchanger 50. A refrigerant circuit including refrigerant lines 35, 45 and 55 provide a closed loop refrigerant flow path coupling these components in a conventional manner for a heat pump system employing the well known Carnot vapor compression cycle. Additionally, the system 10 includes a refrigerant-to-water heat exchanger 60 wherein refrigerant is passed in heat exchange relationship with water to be heated. The water to be heated is pumped by a circulating pump 62 via water circulation line 65 from a water reservoir 64, for example a hot water storage tank or a swimming pool, through the heat exchanger 60 and back to the reservoir 64.

The compressor 20, which may comprise a rotary compressor, a scroll compressor, a reciprocating compressor, a screw compressor or any other type of compressor, has a suction inlet for receiving refrigerant from the suction accumulator 22 and an outlet for discharging compressed refrigerant. The reversing valve 30 may comprise a selectively positionable, two-position, four-port valve having a first port 30-1, a second port 30-2, a third port 30-3 and a fourth port 30-4. The reversing valve 30 is positionable in a first position for coupling the first port and the second port in fluid flow communication and for simultaneously coupling the third port and the fourth port in fluid flow communication. The reversing valve 30 is positionable in a second position for coupling the first port and the third port in fluid flow communication and for simultaneously coupling the second port and the fourth port in fluid flow communication. Advantageously, the respective port-to-port couplings established in the first and second positions are accomplished internally within the valve 30. The outlet 28 of the compressor 20 is connected in fluid flow communication via refrigerant line 35 to the first port 30-1 of the reversing valve 30. The second port 30-2 of the reversing valve 30 is coupled externally of the valve in refrigerant flow communication to the third port 30-3 of the reversing valve 30 via refrigerant line 45. The fourth port 30-4 of the reversing valve 30 is coupled in refrigerant flow communication to the suction inlet 26 of the compressor 20.

The outdoor heat exchanger 40 and the indoor heat exchanger 50 are operatively disposed in the refrigerant line 45. The outdoor heat exchanger 50 is connected in fluid flow communication via section 45A of the refrigerant line 45 with the second port 30-2 of the reversing valve 30. The indoor heat exchanger 50 is connected in fluid flow communication to the third port 30-3 of the reversing valve 30 via section 45C of the refrigerant line 45. Section 45B of the refrigerant line 45 couples the outdoor heat exchanger 40 and the indoor heat exchanger 50 in refrigerant flow communication. A suction accumulator 22 may be disposed in refrigerant line 55 on the suction side of the compressor 20, having its inlet connected in refrigerant flow communication to the fourth port 30-4 of the reserving valve 30 via section 55A of refrigerant line 55 and having its outlet connected in refrigerant flow communication to the suction inlet of the compressor 20 via section 55B of refrigerant line 55. Therefore, refrigerant lines 35, 45 and 55 together couple the compressor 20, the outdoor heat exchanger 40 and the indoor heat exchanger 50 in refrigerant flow communication, thereby creating a closed loop for refrigerant flow circulation through the heat pump system 10.

First and second expansion valves 44 and 54 are disposed in section 45B of the refrigerant line 45. In the embodiments depicted in the drawings, the first expansion valve 44 is operatively associated with the outdoor heat exchanger 40 and the second expansion valve 54 is operatively associated with the indoor heat exchanger 50. Each of the expansion valves 44 and 54 are provided with a bypass line equipped with a check valve permitting flow in only one direction. Check valve 46 in bypass line 43 associated with the outdoor heat exchanger expansion valve 44 passes refrigerant flowing from the outdoor heat exchanger 40 to the indoor heat exchanger 50, thereby bypassing the outdoor heat exchanger expansion valve 44 and passing the refrigerant to the indoor heat exchanger expansion valve 54. Conversely, check valve 56 in bypass line 53 associated with the indoor heat exchanger expansion valve 54 passes refrigerant flowing from the indoor heat exchanger 50 to the outdoor heat exchanger 40, thereby bypassing the indoor heat exchanger expansion valve 54 and passing the refrigerant to the outdoor heat exchanger expansion valve 44. Additionally, the refrigerant-to-water heat exchanger 60 is operatively associated with the refrigerant line 35 whereby refrigerant flowing through the refrigerant line 35 passes in heat exchange relationship with water passing through water circulation line 65.

In the embodiment of the heat pump system 10 depicted in FIGS. 6, 7 and 8, the system includes, in addition to the previously mentioned components, a suction line bypass valve 90 having a first position and a second position, a bypass flow control valve 92 having a valve open state and a valve closed state, such as for example a solenoid valve, a bypass line 93, a bypass line 95 and a check valve 94. The suction line bypass valve 90, which advantageously is a selectively positionable, two-position, four-port valve, is disposed in the refrigeration circuit intermediate the indoor heat exchanger 50 and the reversing valve 30. Refrigerant line 51A extends between the indoor heat exchanger 50 and a first port 90-1 of the suction line bleed valve 90, and refrigerant line 51B extends between the third port 30-3 of the reversing valve 30 and a second port 90-2 of the suction line bleed valve 90, whereby lines 51A and 51B will be connected in refrigerant flow communication whenever the suction line bleed flow valve 90 is in its first position. Refrigerant line 93 extends in flow communication between refrigerant line 73 and a third port 90-3 of the suction line bypass valve 90. Refrigerant line 95 extends in flow communication between a fourth port 90-4 of the suction line bypass valve 90 and refrigerant line 51A, opening to refrigerant line 51A at a location intermediate the indoor heat exchanger 50 and the bypass flow control valve 92, whereby lines 93 and 95 will be also connected in refrigerant flow communication whenever the suction line bleed flow valve 90 is in its first position.

The bypass flow control valve 92 is disposed in refrigerant line 51A and is operative to close the refrigerant line 51A to flow therethrough when in its valve closed state and to open the refrigerant line 51A to flow therethrough when in its valve open state. The check valve 94 is disposed in refrigerant line 95 so as to permit refrigerant to flow through refrigeration line 95 from the suction line bypass valve 90 into refrigerant line 51A, but to block refrigerant flow through the refrigeration line 95 from the refrigeration line 51A to the suction line bypass valve 90. Whenever the suction line bypass valve 90 is in its second position, lines 51A and 93 will be coupled in refrigerant flow communication, and lines 51B and 95 will also be coupled in refrigerant flow communication through the suction line bypass valve 90.

In the system of the invention, the heat pump functions not only either to heat or cool air to a comfort region, but also to heat water on demand. Therefore, the system must operate effectively in an air cooling only mode, an air cooling and water heating mode, an air heating only mode, an air heating and water heating mode, and a water heating only mode. As both the outdoor heat exchanger 40 and the indoor heat exchanger 50 operate as evaporator, condenser or subcooler, depending on the mode and point of operation, condensing may occur in one or two heat exchangers, and the suction line may be filled with refrigerant in a gaseous or liquid state. As a consequence, the amount of system refrigerant charge required in each mode in order to ensure operation within an acceptable efficiency envelope will be different for each mode. When water heating is not required, the amount of refrigerant charge required will also be affected by the amount of heat exchange due to the occurrence of thermo-siphoning in the refrigerant-to-water heat exchanger 60.

Accordingly, the system 10 further includes a refrigerant storage reservoir 70, termed a charge tank, having an inlet connected in fluid flow communication with the refrigerant line 45 via refrigerant line 71 and an outlet connected in fluid flow communication with the refrigerant line 55 via refrigerant line 73, a first flow control valve 72 disposed in the refrigerant line 71, and a second flow control valve 74 disposed in the refrigerant line 73. Each of the first and second flow control valves 72 and 74 has an open position and a closed position so that flow therethrough may be selectively controlled whereby the refrigerant charge within the refrigerant circuit may be actively controlled. Advantageously, each of the first and second flow control valves 72 and 74 may also have at least one partially open position and may be a pulse width modulated solenoid valve. Additionally, a liquid level meter 80, such as for example a transducer, may be disposed in the charge tank 70 for monitoring the refrigerant level within the charge tank.

Figure 9:
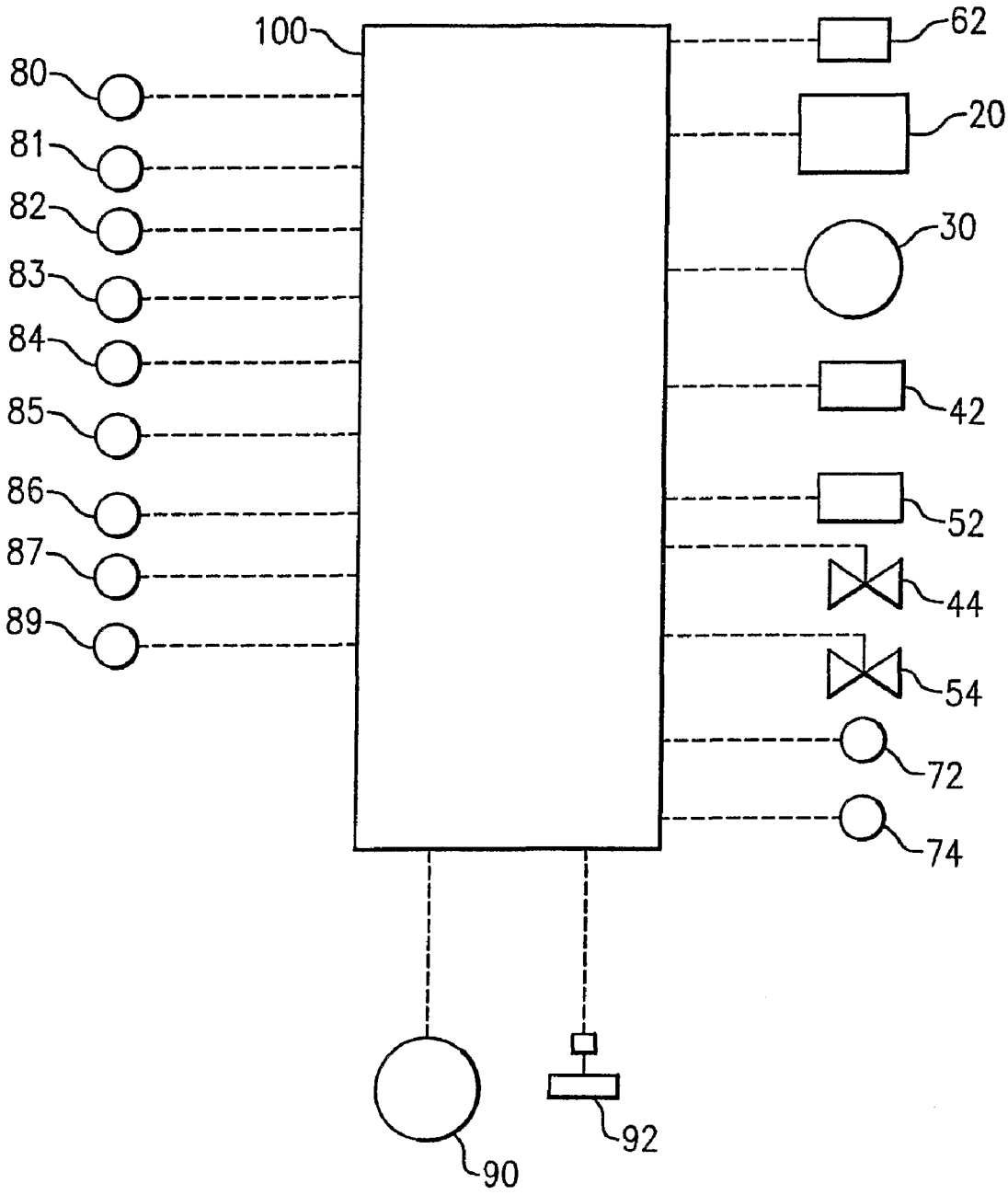
FIG. 9 is a schematic diagram illustrating an embodiment of a control system arrangement for the heat pump system of the invention.

Referring now to FIG. 9, a system controller 100, advantageously a microprocessor, controls the operation of the water pump 62, the compressor 20, the reversing valve 30 and other heat pump components, such as the outdoor heat exchanger fan 42 and the indoor heat exchanger fan 52, in response to the cooling or heating demand of the comfort region in a conventional manner and/or the demand for water heating. In the embodiment depicted in FIGS. 6, 7 and 8, the system controller also controls operation of the suction line bypass valve 90 and the bypass flow control valve 92. In addition, the system controller 100 controls the opening and closing of the flow control valves 72 and 74 to adjust the refrigerant charge to coordinate with system requirements for the various modes of operation. The system controller 100 receives input signals indicative of various system operational parameters from a plurality of sensors, including, without limitation, a suction temperature sensor 81, a suction pressure sensor 83, a discharge temperature sensor 85, a discharge pressure sensor 87, a water temperature sensor 89, an outdoor heat exchanger refrigerant temperature sensor 82, an indoor heat exchanger refrigerant temperature sensor 84, and a refrigerant temperature sensor 86 disposed in operative association with section 45B of refrigerant line 45 at a location between the expansion valves 44 and 54.

The suction temperature sensor 81 and the suction pressure sensor 83 are disposed in operative association with refrigerant line 55 near the suction inlet to the compressor 20 as in conventional practice for sensing the refrigerant temperature and pressure, respectively, at the compressor suction inlet and for passing respective signals indicative thereof to the system controller 100. The discharge temperature sensor 85 and the discharge pressure sensor 87 are disposed in operative association with refrigerant line 35 near the discharge outlet to the compressor 20 as in conventional practice for sensing the refrigerant temperature and pressure, respectively, at the compressor discharge outlet and for passing respective signals indicative thereof to the system controller 100. The water temperature sensor 89 is disposed in operative association with the water reservoir 64 for sensing the temperature of the water therein and for passing a signal indicative of the sensed water temperature to the system controller 100. The temperature sensor 82 is disposed in operative association with the outdoor heat exchanger 40 at a location appropriate for measuring the refrigerant phase change temperature of refrigerant passing therethrough when the outdoor heat exchanger is operating and for sending a signal indicative of that sensed temperature to the system controller 100 for controlling operation of the expansion valve 44. Similarly, the temperature sensor 84 is disposed in operative association with the indoor heat exchanger 50 at a location appropriate for measuring the refrigerant phase change temperature of refrigerant passing therethrough when the indoor heat exchanger is operating and for sending a signal indicative of that sensed temperature to the system controller 100 for controlling operation of the expansion valve 54. The system controller 100 determines the degree of superheat from the refrigerant temperature sensed by whichever of sensors 82 and 84 is associated with the heat exchanger that is acting as an evaporator in the current operating mode. The refrigerant temperature sensor 86 operatively associated with refrigerant line 45 senses the temperature of the refrigerant at a location between the expansion valves 44 and 54 and passes a signal indicative of the sensed temperature to the system controller 100. The system controller determines the degree of subcooling present from the sensed temperature received from temperature sensor 86.

Figure 1:
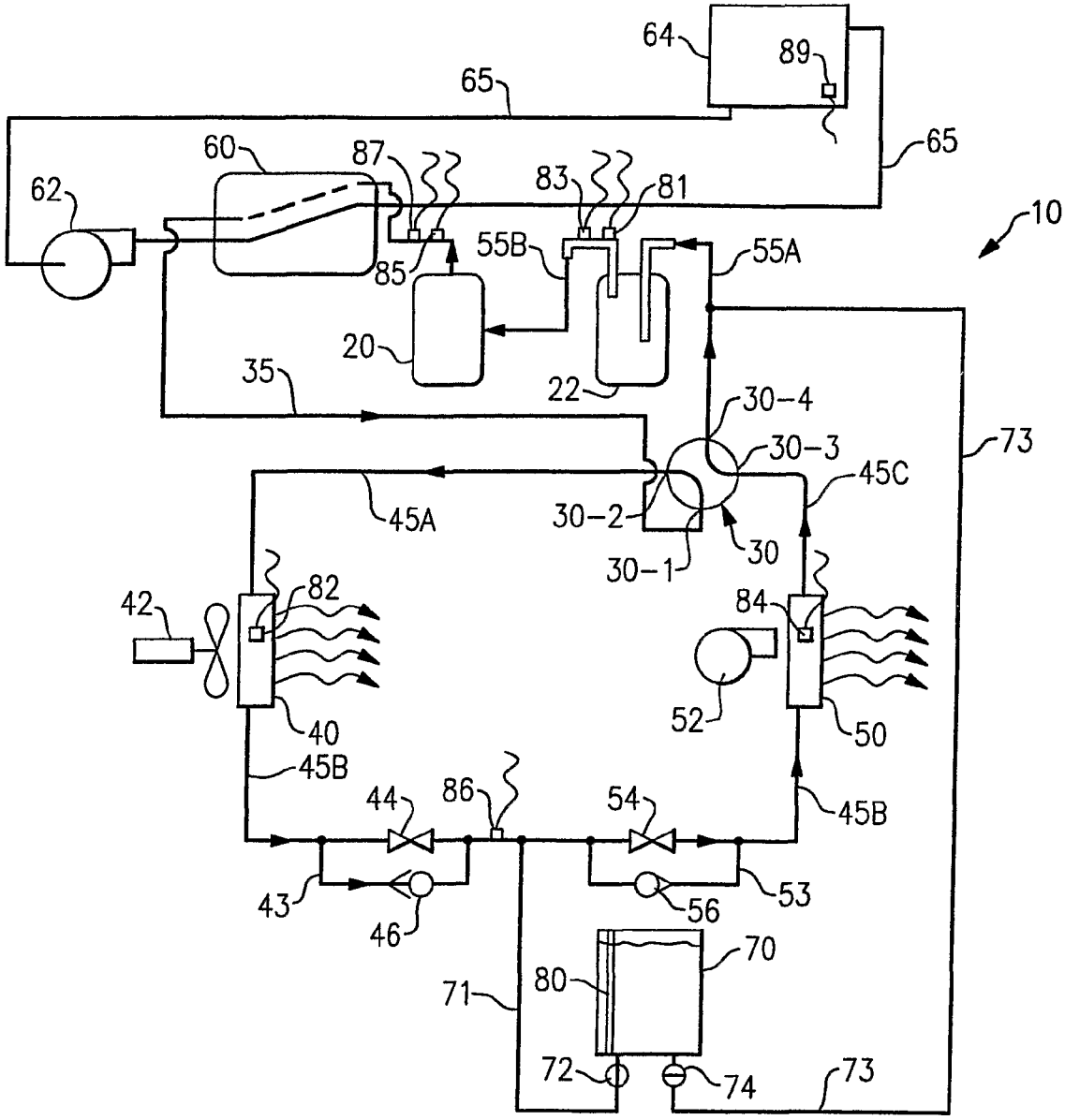
FIG. 1 is a schematic diagram illustrating a first embodiment of the heat pump system of the invention illustrating operation in the indoor air cooling only mode.

Referring now to FIG. 1, in the indoor air cooling only mode, in response to a demand for cooling, the system controller 100 activates the compressor 20, the outdoor heat exchanger fan 42 and the indoor heat exchanger fan 52. High pressure, superheated refrigerant from the compressor 20 passes through refrigerant line 35 to the reversing valve 30 wherein the refrigerant is directed to and through section 45A of refrigerant line 45 to the outdoor heat exchanger 40, which in the air cooling mode functions as a condenser. With the outdoor heat exchanger fan 42 operating, ambient air flows through the outdoor heat exchanger 40 in heat exchange relationship with the refrigerant passing therethrough, whereby the high pressure refrigerant is condensed to a liquid and subcooled. High pressure liquid refrigerant passes from the outdoor heat exchanger 40 through section 45B of refrigerant line 45 to the indoor heat exchanger 50, which in the air cooling mode functions as an evaporator. In passing through section 45B of refrigerant line 45, the high pressure liquid refrigerant bypass the expansion valve 44 through bypass line 43 and check valve 46 and thence passes through the expansion valve 54 wherein the high pressure liquid refrigerant expands to a lower pressure, thereby further cooling the refrigerant prior to the refrigerant entering the indoor heat exchanger 50. As the refrigerant traverses the indoor heat exchanger, the refrigerant evaporates. With the indoor heat exchanger fan 52 operating, indoor air passes through the indoor heat exchanger 50 in heat exchange relationship with the refrigerant thereby evaporating the refrigerant and cooling the indoor air. The refrigerant passes from the indoor heat exchanger through section 45C of refrigerant line 45 to the reversing valve 30 and is directed through section 55A of refrigerant line 55 to the suction accumulator 22 before returning to the compressor 20 through section 55B of refrigerant line 55 connecting to the suction inlet of the compressor 20.

Figure 2:
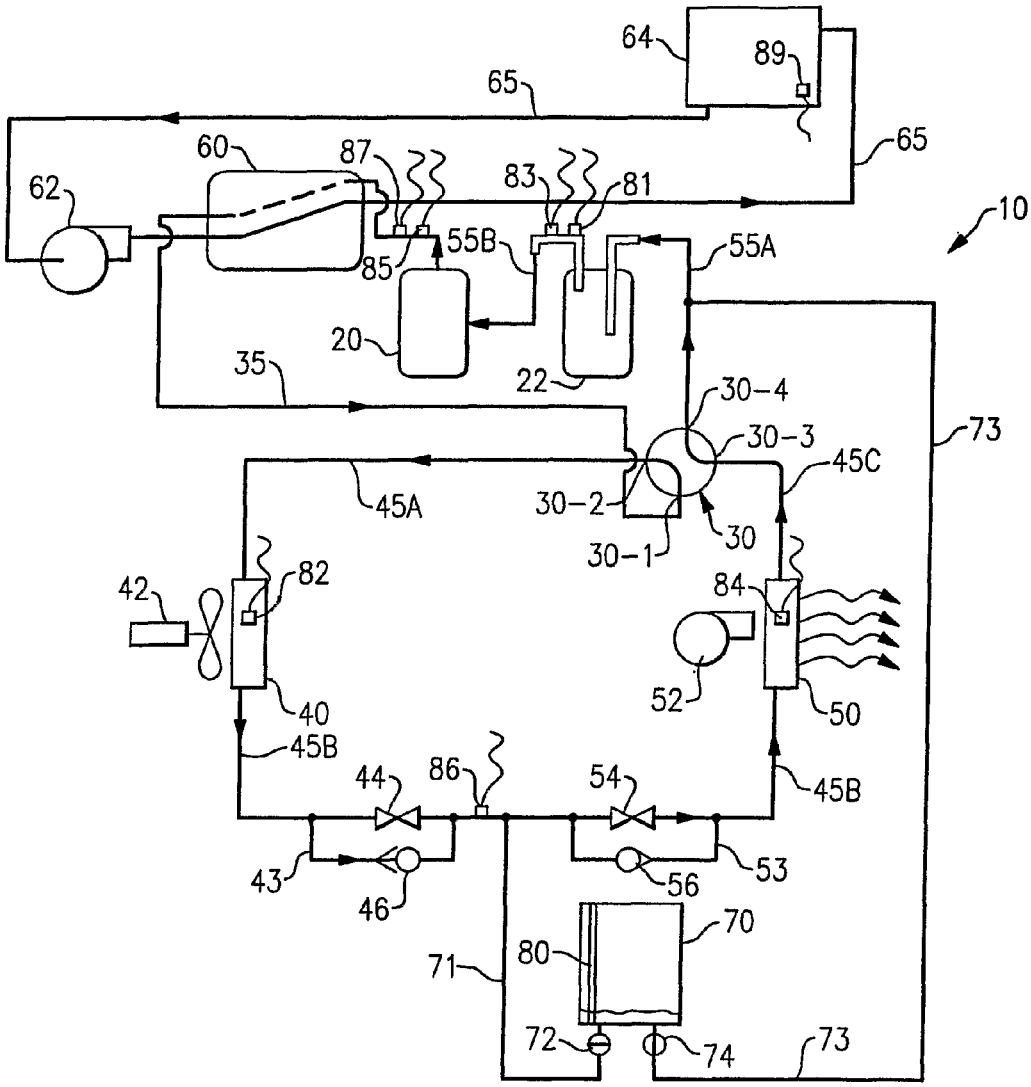
FIG. 2 is a schematic diagram illustrating a first embodiment of the heat pump system of the invention illustrating operation in the indoor air cooling with water heating mode.

In passing through the refrigerant line 35, the refrigerant passes through the heat exchanger 60 wherein the refrigerant passes in heat exchange relationship with the water in line 65. In the air cooling only mode, the amount of heat exchanged from the refrigerant to the water is small as the water pump 62 is turned off. Therefore, only a small amount of water flows through the heat exchanger 60, the water flow through line 65 being driven by a thermo-siphon effect. However, even with the water flow being small in the air cooling only mode eventually the heat exchange could be enough to desuperheat the refrigerant. Referring now to FIG. 2, when there is a demand for water heating while the heat pump is in the indoor air cooling mode, the system controller 100 activates the water pump 60 and water is pumped via water line 65 from storage tank 64 through heat exchanger 60 in heat exchange relationship with the high pressure superheated refrigerant flowing through refrigerant line 35. As the refrigerant passes through the heat exchanger 60, the refrigerant is condensed and subcooled as it gives up heat to heat the water flowing through the heat exchanger 60 in heat exchange relationship with the refrigerant. Since in this air cooling with water heating mode, the refrigerant passing through section 45A of refrigerant line 45 to the outdoor heat exchanger 40 has already been condensed and subcooled when passing through the heat exchanger 60 in heat exchange relationship with the water, there is no need for any significant further cooling in the outdoor heat exchanger. Further, additional subcooling would decrease the water heating capacity. Therefore, in this indoor air cooling with water heating mode, the system controller 100 turns off the outdoor heat exchanger fan 42 so that ambient air is not passed through the outdoor heat exchanger 40, thereby minimizing the amount of heat loss experienced by the refrigerant passing therethrough so that the refrigerant undergoes only a relatively small amount of additional subcooling. However, when the temperature of the water in reservoir 64 approaches its set point, it may be desirable to activate the outdoor fan 52 to improve the operating efficiency of the system.

The condensed and subcooled liquid refrigerant leaving the outdoor heat exchanger 40 passes through section 45B of refrigerant line 45 to the indoor heat exchanger 50, which in the air cooling mode functions as an evaporator. In passing through refrigerant line 45B, the high pressure liquid refrigerant bypass the expansion 44 through bypass line 43 and check valve 46 and thence passes through the expansion valve 54 wherein the high pressure liquid refrigerant expands to a lower pressure, thereby further cooling the refrigerant prior to the refrigerant entering the indoor heat exchanger 50. As the refrigerant traverses the indoor heat exchanger, the refrigerant evaporates. With the indoor heat exchanger fan 52 operating, indoor air passes through the indoor heat exchanger 50 in heat exchange relationship with the refrigerant thereby evaporating the refrigerant and cooling the indoor air. The refrigerant passes from the indoor heat exchanger through section 45C of refrigerant line 45 to the reversing valve 30 and is directed through section 55A of refrigerant line 55 to the suction accumulator 22 before returning to the compressor 20 through section 55B of refrigerant line 55 connecting to the suction inlet of the compressor 20.

Figure 3:
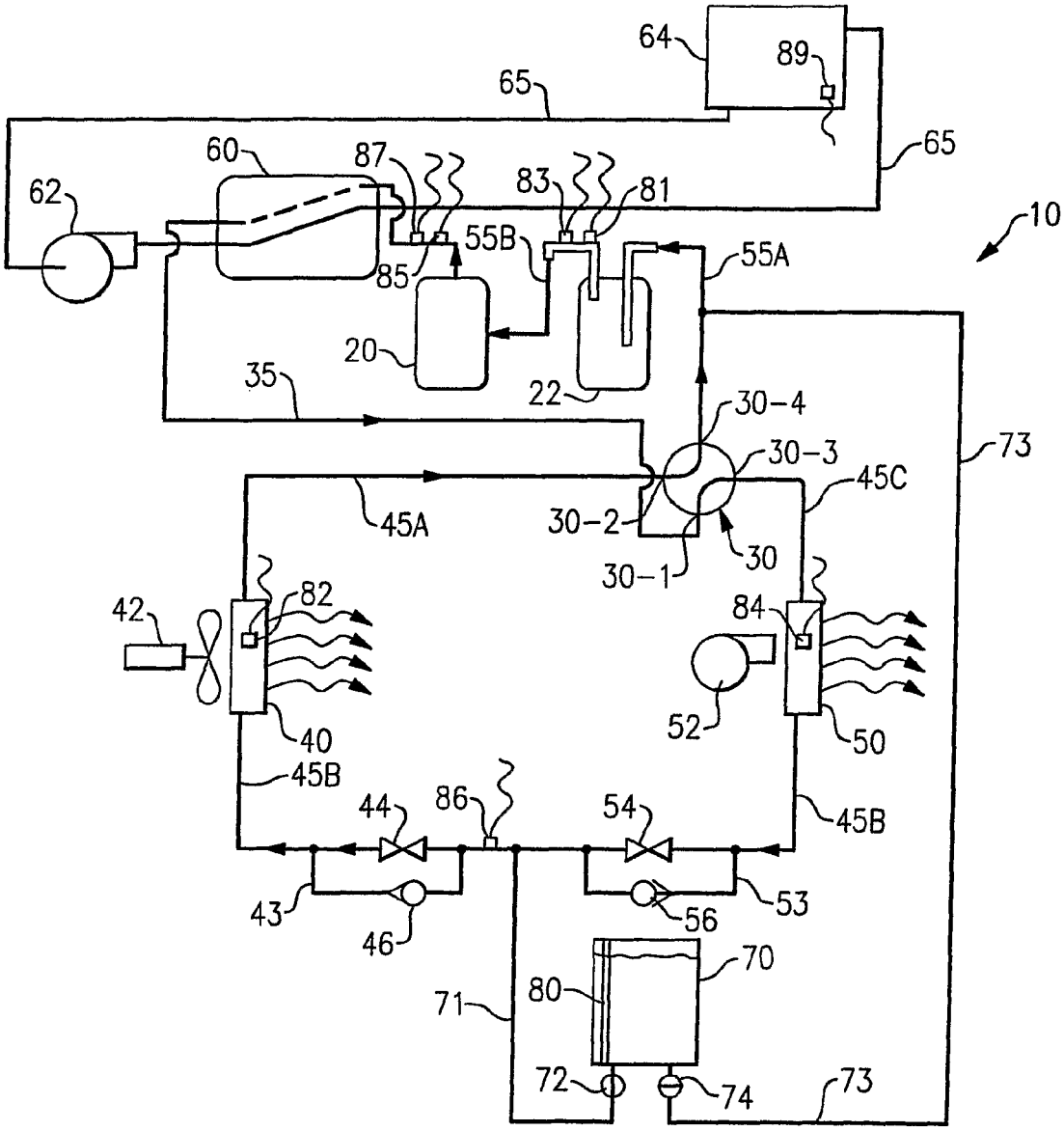
FIG. 3 is a schematic diagram illustrating a first embodiment of the heat pump system of the invention illustrating operation in the indoor air cooling only mode.

Referring now to FIG. 3, in the indoor air heating only mode, in response to a demand for heating, the system controller 100 activates the compressor 20, the outdoor heat exchanger fan 42 and the indoor heat exchanger fan 52. High pressure, superheated refrigerant from the compressor 20 passes through refrigerant line 35 to the reversing valve 30 wherein the refrigerant is directed to and through section 45C of refrigerant line 45 to the indoor heat exchanger 50, which in the air heating mode functions as a condenser. With the indoor heat exchanger fan 52 operating, indoor air passes through the indoor heat exchanger 50 in heat exchange relationship with the refrigerant passing therethrough, whereby the high pressure refrigerant is condensed to a liquid and subcooled 50 and the indoor air is heated. High pressure liquid refrigerant passes from the indoor heat exchanger 50 through section 45B of refrigerant line 45 to the outdoor heat exchanger 40, which in the air heating mode functions as an evaporator. In passing through section 45B of refrigerant line 45, the high pressure liquid refrigerant bypass the expansion valve 54 through bypass line 53 and check valve 56 and thence passes through the expansion valve 44 wherein the high pressure liquid refrigerant expands to a lower pressure, thereby further cooling the refrigerant prior to the refrigerant entering the outdoor heat exchanger 40. With the outdoor heat exchanger fan 42 operating, ambient air passes through the outdoor heat exchanger and as the refrigerant traverses the outdoor heat exchanger, the refrigerant evaporates. The refrigerant passes from the outdoor heat exchanger 40 through section 45A of refrigerant line 45 to the reversing valve 30 and is directed through section 55A of refrigerant line 55 to the suction accumulator 22 before returning to the compressor 20 through section 55B of refrigerant line 55 connecting to the suction inlet of the compressor 20.

In passing through the refrigerant line 35, the refrigerant passes through the heat exchanger 60 wherein the refrigerant passes in heat exchange relationship with the water in line 65. In the air cooling only mode, the amount of heat exchanged from the refrigerant to the water is small as the water pump 62 is turned off. Therefore, only a small amount of water flows through the heat exchanger 60, the water flow through line 65 being driven by a thermo-siphon effect. However, even with the water flow being small in the air cooling only mode eventually the heat exchange could be enough to desuperheat the refrigerant.

Referring now to FIG. 4, when there is a demand for water heating while the heat pump is in the indoor air heating mode, the system controller 100 activates the water pump 60 and water is pumped via water line 65 from storage tank 64 through heat exchanger 60 in heat exchange relationship with the high pressure superheated vapor refrigerant flowing through refrigerant line 23. As the refrigerant passes through the heat exchanger 60, the refrigerant is partially condensed or condensed and partially subcooled, depending primarily upon the water temperature and the indoor air temperature, as it gives up heat to heat the water flowing through the heat exchanger 60 in heat exchange relationship with the refrigerant. In this air heating with water heating mode, although the refrigerant passing through section 45C of refrigerant line 45 to the indoor heat exchanger 50 has already been partially condensed, or condensed and partially subcooled, when passing through the heat exchanger 60 in heat exchange relationship with the water, there is still a need to heat the indoor air. Therefore, in this indoor air heating with water heating mode, the system controller 100 activates the indoor heat exchanger fan 52 so that indoor air is passed through the indoor heat exchanger 50 in heat exchange relationship with the refrigerant passing therethrough, thereby heating the indoor air being supplied to the comfort zone and further completing the condensation and/or subcooling of the refrigerant.

The high pressure, subcooled liquid refrigerant passing from the indoor heat exchanger 50 passes through section 45B of refrigerant line 45 to the outdoor heat exchanger 40, which in the air heating mode functions as an evaporator. In passing through section 45B of refrigerant line 45, the high pressure liquid refrigerant bypass the expansion valve 54 through bypass line 53 and check valve 56 and thence passes through the expansion valve 44 wherein the high pressure liquid refrigerant expands to a lower pressure, thereby further cooling the refrigerant prior to the refrigerant entering the outdoor heat exchanger 40. With the outdoor heat exchanger fan 42 operating, ambient air passes through the outdoor heat exchanger and as the refrigerant traverses the outdoor heat exchanger, the refrigerant evaporates. The refrigerant passes from the outdoor heat exchanger 40 through section 45A of refrigerant line 45 to the reversing valve 30 and is directed through section 55A of refrigerant line 55 to the suction accumulator 22 before returning to the compressor 20 through section 55B of refrigerant line 55 connecting to the suction inlet of the compressor 20.

Referring now to FIG. 5, when there is a demand for water heating while the heat pump is off, that is not in either the indoor air cooling or heating mode, the system controller 100 activates the water pump 60, the compressor 20, and the outdoor heat exchanger fan 42, but not the indoor heat exchanger fan 52. With the pump 60 turned on, water is pumped via water line 65 from storage tank 64 through heat exchanger 60 in heat exchange relationship with the high pressure superheated vapor refrigerant flowing through refrigerant line 35. As the refrigerant passes through the heat exchanger 60, the refrigerant is condensed and subcooled as it gives up heat to heat the water flowing through the heat exchanger 60 in heat exchange relationship with the refrigerant. The refrigerant leaving the heat exchanger 60 continues through line 35 to the reversing valve 30 which directs the refrigerant through section 45C of refrigerant line 45 to the indoor heat exchanger 50. In this water heating only mode, the indoor heat exchanger fan 52 is turned off so that indoor air is not be passed through the indoor heat exchanger as no demand exists for either cooling or heating the indoor air in the comfort zone. Therefore, no further subcooling of the refrigerant occurs in the indoor heat exchanger in the water heating only mode. Having the traversed the indoor heat exchanger 50 without further subcooling, the high pressure, subcooled liquid refrigerant passes through section 45B of refrigerant line 45 to the outdoor heat exchanger 40, which in the air heating mode functions as an evaporator. In passing through section 45B of refrigerant line 45, the high pressure liquid refrigerant bypass the expansion valve 54 through bypass line 53 and check valve 56 and thence passes through the expansion valve 44 wherein the high pressure liquid refrigerant expands to a lower pressure, thereby further cooling the refrigerant prior to the refrigerant entering the outdoor heat exchanger 40. With the outdoor heat exchanger fan 42 operating, ambient air passes through the outdoor heat exchanger and as the refrigerant traverses the outdoor heat exchanger, the refrigerant evaporates. The refrigerant passes from the outdoor heat exchanger 40 through section 45A of refrigerant line 45 to the reversing valve 30 and is directed through section 55A refrigerant line 55 to the suction accumulator 22 before returning to the compressor 20 through section 55B of refrigerant line 55 connecting to the suction inlet of the compressor 20.

Referring now to FIG. 6 depicting the second embodiment of the heat pump system of the invention operating in the air cooling only mode, the suction line bleed valve 90 is positioned in its first position as illustrated in FIG. 6 and the bypass flow control valve 92 is in its open position. So positioned, refrigerant line 51A and 51B are connected in flow communication via the suction line bypass valve 90 and refrigerant follows the same route through the various components of the refrigerant circuit as described hereinbefore with respect to FIG. 1. Additionally, lines 93 and 95 are also connected in flow communication via the suction line bypass valve 90, whereby refrigerant from the charge tank 70 can enter the refrigerant circuit whenever the solenoid valve 74 in line 73 is opened by the system controller. Flow into line 95 from line 51A is blocked by check valve 94. In the air cooling and water heating mode, the suction line bleed valve 90 is again positioned in its first position as illustrated in FIG. 6 and the bypass flow control valve 92 is in its open position. So positioned, refrigerant line 51A and 51B are again connected in flow communication via the suction line bypass valve 90 and refrigerant follows the same route through the various components of the refrigerant circuit as described hereinbefore with respect to FIG. 2.

In the indoor air heating only mode, the suction line bleed valve 90 may be positioned in either its first position or in its second position, depending upon the magnitude of the thermo-siphon effect experienced in traversing the water heat exchanger 60. If the impact of the thermo-siphon effect is relatively low, the suction line bleed valve 90 will be positioned in its first position by the system controller as illustrated in FIG. 7. However, if the impact of the thermo-siphon is moderate to relatively high, the system controller will position the suction line bleed valve 90 in its second position as illustrated in FIG. 8. When the suction line bypass valve 90 is in its first position, the system controller will position the bypass flow control valve 92 in its open state. When the suction line bypass valve 90 is in its second position, the system controller will position the bypass flow control valve 92 in its open position, the system controller will position the bypass flow control valve in its closed state.

Referring now to FIG. 7, when in the air heating only mode with the suction line bypass valve 90 in its first position, refrigerant lines 51A and 51B are connected in flow communication via the suction line bypass valve 90 and refrigerant follows the same route through the various components of the refrigerant circuit as described hereinbefore with respect to FIG. 3. Additionally, lines 93 and 95 are also connected in flow communication via the suction line bypass valve 90, whereby refrigerant from the charge tank 70 can enter the refrigerant circuit whenever the solenoid valve 74 in line 73 is opened by the system controller. As flow into line 95 from line 51*a* is blocked by check valve 94, any refrigerant resident in line 95 on the suction side of the check valve 94 will bleed back to the compressor through line 73.

Referring now to FIG. 8, when in the air heating only mode with the suction line bypass valve 90 in its second position, refrigerant lines 51B and 95 are connected in flow communication via the suction line bypass valve 90 and refrigerant follows to the indoor heat exchanger 50 through refrigerant line 95, rather than through line 51A, but the refrigerant flows through the various components of the refrigerant circuit in the same general sequence as described hereinbefore with respect to FIG. 3. Refrigerant lines 93 and 51A are also connected in flow communication via the suction line bypass valve 90. Once the bypass flow control valve 92 in line 51A is closed preventing flow through line 51A, any refrigerant remaining in line 51A on the suction side of the valve 92 bleeds to the compressor 20 through line 93 to line 73. Additionally, with refrigerant lines 93 and 51A connected in flow communication via the suction line bypass valve 90, refrigerant from the charge tank 74 can enter the refrigerant circuit whenever the solenoid valve 74 in line 73 is opened by the system controller.

In the air heating with water heating mode and in the water heating only mode, the suction line bypass valve 90 remains positioned in its second position as illustrated in FIG. 8, refrigerant lines 51B and 95 are connected in flow communication via the suction line bypass valve 90 and refrigerant follows to the indoor heat exchanger 50 through refrigerant line 95, rather than through line 51A, but the refrigerant flows through the various components of the refrigerant circuit in the same general sequence as described hereinbefore with respect to FIG. 4 and FIG. 5, respectively. Once the bypass flow control valve 92 in line 51A is closed preventing flow through line 51A, any refrigerant remaining in line 51A on the suction side of the valve 92 bleeds to the compressor 20 through line 93 to line 73. Additionally, refrigerant lines 93 and 51A are connected in flow communication via the suction line bypass valve 90, whereby refrigerant from the charge tank 70 can enter the refrigerant circuit whenever the solenoid valve 74 in line 73 is opened by the system controller. In the air heating with water heating mode, the indoor heat exchanger fan 52 will be operating as illustrated in FIG. 4, while in the water heating only mode, the indoor heat exchanger fan 52 will not be operating as illustrated in FIG. 5.

As noted hereinbefore, the heat pump system of the invention must operate effectively in an air cooling only mode, an air cooling and water heating mode, an air heating only mode, an air heating and water heating mode, and a water heating only mode. As both the outdoor heat exchanger 40 and the indoor heat exchanger 50 operate as evaporator, condenser or subcooler, depending on the mode and point of operation, condensing may occur in one or two heat exchangers, and the suction line may be filled with refrigerant in a gaseous or liquid state. As a consequence, the amount of system refrigerant charge required in each mode in order to ensure operation within an acceptable efficiency envelope will be different for each mode. When water heating is not required, the amount of refrigerant charge required will also be affected by the amount of heat exchange due to the occurrence of thermosiphoning in the refrigerant-to-water heat exchanger 60.

Accordingly, the system controller system 100 controls the amount of refrigerant flowing through the refrigerant circuit at any time, i.e. the refrigerant charge, by monitoring and adjusting the level of refrigerant in the charge tank 70 by selectively opening and closing the first flow control valve 72 disposed in the refrigerant line 71 and a second flow control valve 74 disposed in the refrigerant line 73.

Figure 10:
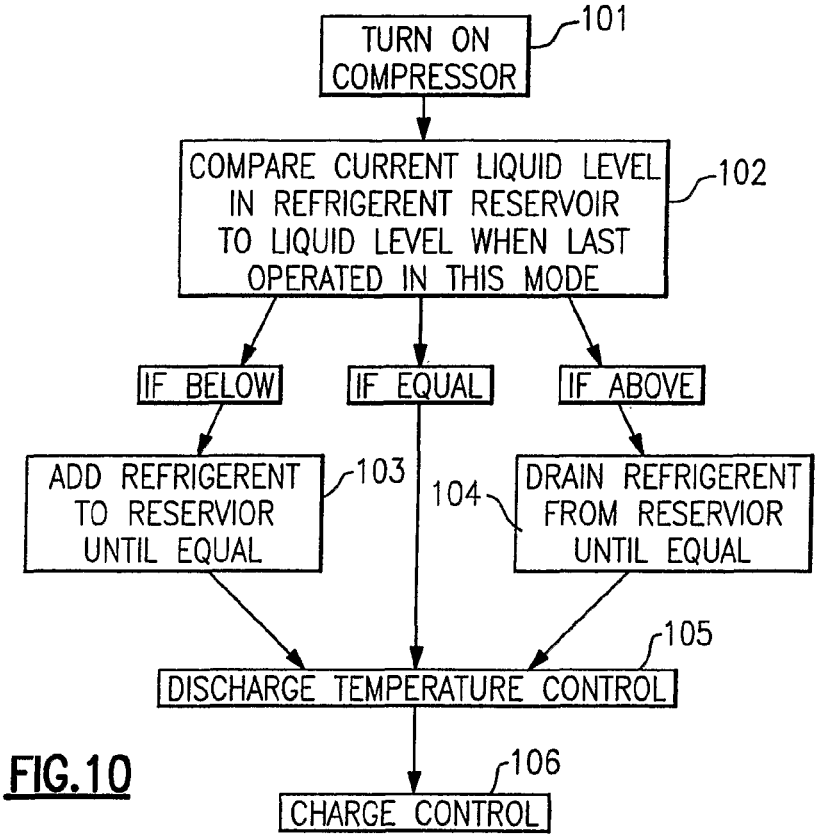
FIG. 10 is block diagram illustrating a first embodiment of a refrigerant charge adjustment procedure at start-up in a new mode of operation.

In a most advantageous embodiment, the charge tank 70 is provided with a liquid level meter 80 that generates and transmits a signal indicative of the refrigerant level within the charge tank 70 to the system controller 100. The liquid level meter 80 may be configured to transmit a liquid level signal to the system controller 100 continuously, on a periodic basis at specified intervals, or only when prompted by the controller. Referring now to FIG. 10, in operation, when the controller switches from one mode of operation to a new mode of operation, the controller 100 turns on the compressor 20 at block 101, and then, at block 102, the controller 100 compares the then current liquid level in the charge tank 70 with the liquid level last experienced the last time the system was operated in a mode equivalent to the new mode of operation, the liquid level last experienced having been stored in the controller's memory. If the current level is the same as the last experienced level for this particular mode of operation, the controller at block 105 activates the discharge temperature control procedure and/or at block 106 the normal charge control procedure.

However, if the current liquid level is not the same as the last experienced level for this particular mode of operation, the controller 100 will selectively modulate the solenoid valves 72 and 74 to open and close as necessary to adjust the current liquid level to equal the last experienced level for this particular mode of operation. If the current level is below the last experienced level, at block 103 the controller 100 will close the solenoid valve 74 and modulate the solenoid valve 72 open to drain refrigerant from the refrigerant circuit into the charge tank 70 until the current reaches the last experience level. Conversely, if the current level is above the last experienced level, the controller 100 at block 104 will close the solenoid valve 72 and modulate the solenoid valve 74 open to drain refrigerant from the charge tank 70 into the refrigerant circuit until the current liquid level reaches the last experienced level. For example, the controller will open the appropriate valve for a short period of time, for example 2 seconds, close the valve, recheck the level and repeat this sequence until the current liquid level equalizes to the last experience level. Once the current level has been equalized to the last experienced level, the controller activates the normal charge control procedure and/or discharge temperature control procedure.

The system controller 100 may also employ the control procedure discussed herein in embodiments of the heat pump system of the invention that do not include a liquid level sensor in association with the charge tank 70. However, when the heat pump system switches to a new operation mode, the system controller 100 first fills the charge tank with refrigerant in the liquid state or with refrigerant in the gas state depending upon the particular mode of operation being entered.

Figure 11:
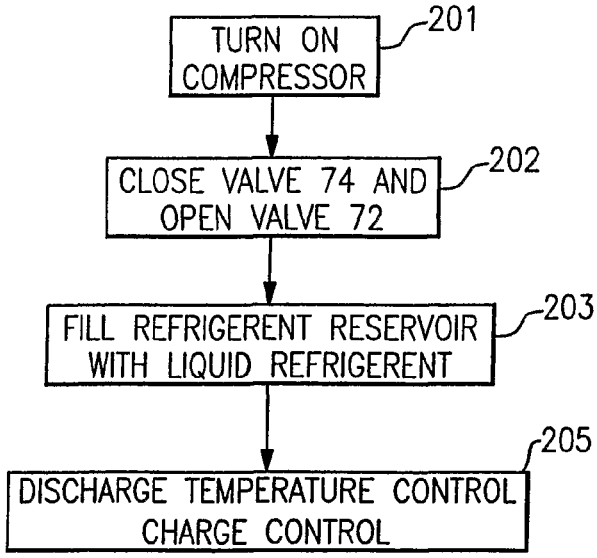
FIG. 11 is a block diagram illustrating a second embodiment of a refrigerant charge adjustment procedure at start-up in a new mode of operation.

If the new mode of operation does not involve water heating, the system controller will proceed according to the procedure illustrated by the block diagram in FIG. 11 to fill the refrigerant tank 70 with liquid refrigerant. After turning the compressor 20 on at block 201, the system controller at block 202 closes solenoid valve 74 and opens solenoid valve 72 to allow liquid refrigerant to pass from line 71 into the charge tank 70. After a programmed time delay at block 203 sufficient to allow the charge tank 70 to fill with liquid refrigerant, for example about 3 minutes, the system controller proceeds to adjust the refrigerant circuit charge as need by the discharge temperature control procedure and/or the charge control procedure at block 205 as desired. The solenoid valve 72 may be positioned either open or closed at this point.

Figure 12:
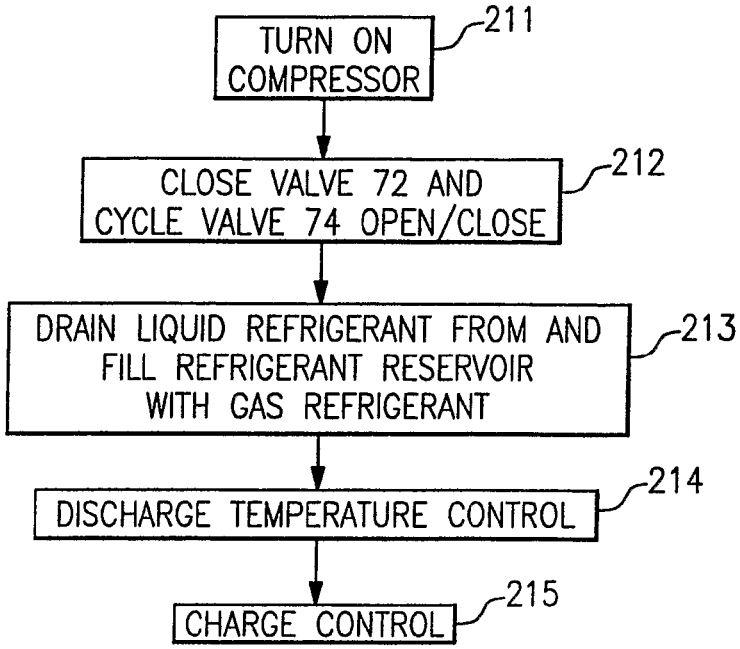
FIG. 12 is a block diagram illustrating a third embodiment of a refrigerant charge adjustment procedure at start-up in a new mode of operation.

However, if the new mode of operation does involve water heating, the system controller will proceed according to the procedure illustrated by the block diagram in FIG. 12 to fill the refrigerant tank 70 with gaseous refrigerant. After turning the compressor 20 on at block 211, the system controller at block 212 closes solenoid valve 72 and modulates solenoid valve 74 on/off for a period of time, for example open 3 seconds, closed 17 seconds repeatedly for two minutes, to allow refrigerant in the gas state to pass from line 73 into the charge tank 70. After a programmed time delay at block 213 sufficient to allow the charge tank 70 to fill with gaseous refrigerant, for example about 3 minutes, the system controller proceeds to adjust the refrigerant circuit charge as need by the discharge temperature control procedure at block 214 and the charge control procedure at block 215 as desired. The solenoid valve 74 may be positioned either open or closed at this point. In any water heating mode, the controller 100 will shut the pump 62 off when temperature sensor 89 detects that the water temperature in water reservoir 64 has reached a desired limit value, for example 60 degrees C.

Figure 13:
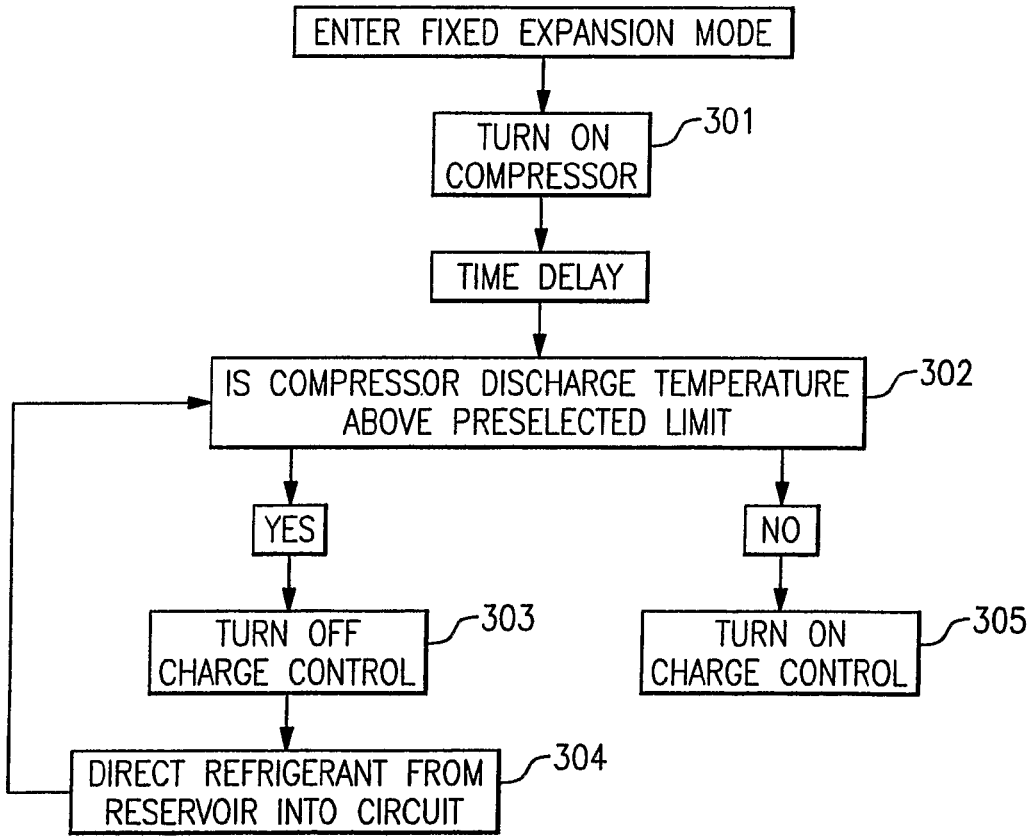
FIG. 13 is a block diagram illustrating a discharge temperature limit control procedure for adjusting refrigerant charge post start-up.

In accord with the discharge temperature limit control procedure, illustrated by the block diagram of FIG. 13, upon entering a fixed expansion mode, after turning the compressor 20 on at block 301 and a brief time delay, for example about 30 seconds, the system controller at block 302 compares the current discharge temperature, TDC, i.e. the temperature of the refrigerant discharging from the compressor 20, received from temperature sensor 85 to a discharge temperature limit, TDL, preprogrammed into the controller 100. A typical compressor discharge limit might be a desired number of degrees, for example about 7 degrees C., below the manufacturer's application guide specification. A typical compressor discharge temperature limit would be about 128 degrees C. If the current discharge temperature, TDC, exceeds the discharge temperature limit, the system controller 100 at block 303 deactivates the charge control procedure if it is currently active, and then at block 304 closes the solenoid valve 72 and modulates the solenoid valve 74 open to drain refrigerant from the charge tank 70 into the refrigerant circuit through the refrigerant line 73. If the current discharge temperature received from temperature sensor 85 is equal to or below the discharge temperature limit, the system controller 100 at block 305 activates the charge control procedure if it is not currently active and proceeds to follow the charge control procedure to adjust the refrigerant charge in the refrigerant circuit as necessary.

Figure 14:
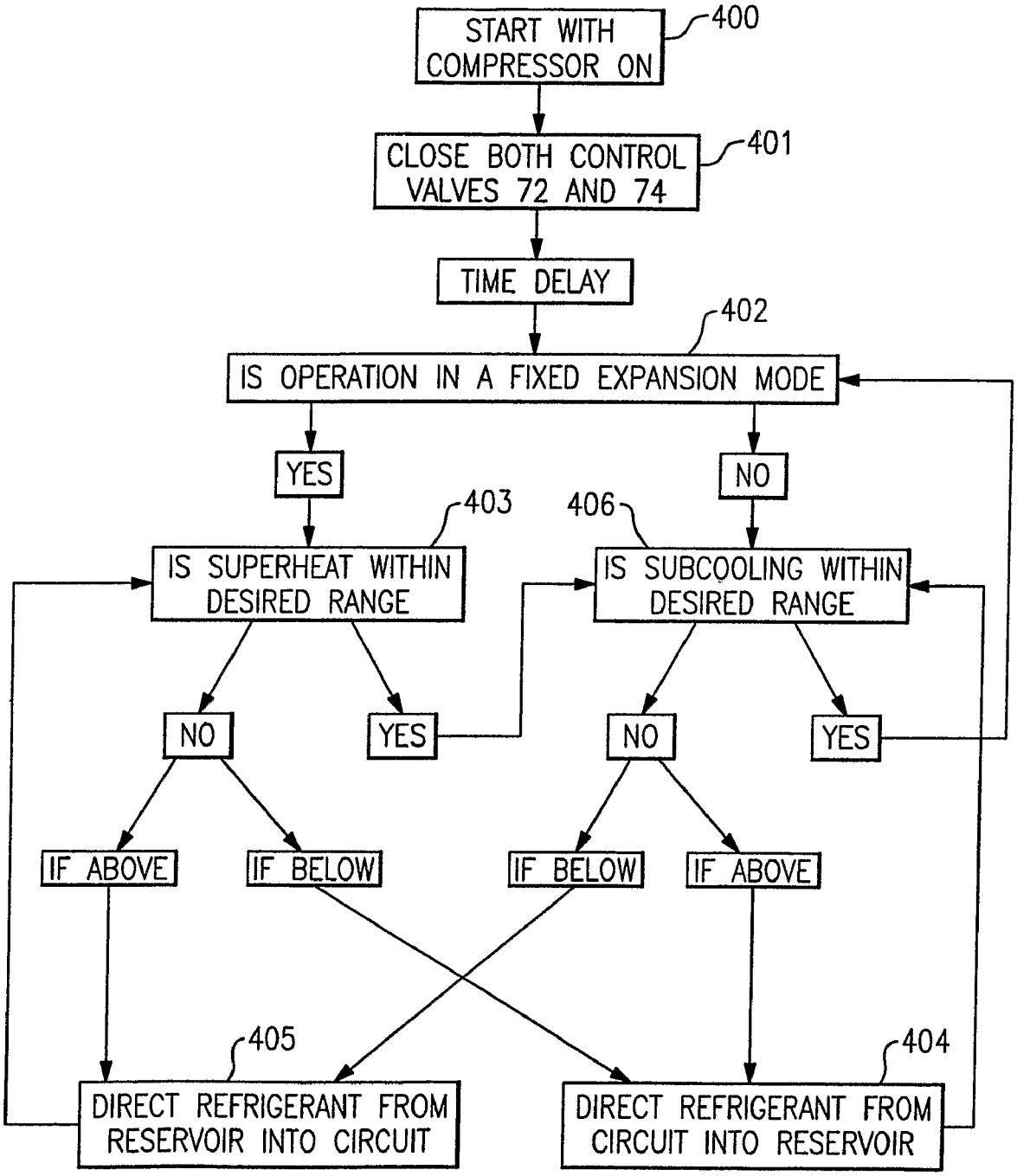
FIG. 14 is a block diagram illustrating a charge control procedure for adjusting refrigerant charge post start-up.

In the charge control procedure, illustrated in FIG. 14, with the refrigerant charge initially set, after ensuring that the compressor 20 is on at block 400, the system controller 100 at block 401 closes both solenoid valves 72 and 74. After a brief time delay, for example about one minute, depending upon the particular mode of current operation, the system controller will at block 403 compare either or both of the degree of superheat or the degree of subcooling currently present in the system to a permissible range of superheat preprogrammed into the controller 100. For example, in the air cooling only and the air cooling with water heating modes, the permissible range of superheat may be from 0.5 to 20 degrees C. and the permissible range of subcooling may be from 2 to 15 degrees C. In the air heating only, the air heating with water heating and the water heating only modes, the permissible range of superheat may be from 0.5 to 11 degrees C. and the permissible range of subcooling may be from 0.5 to 10 degrees C., for example.

After determining at block 402 that the system is operating in a mode with fixed expansion, the system controller, at block 403, compares the current degree of superheat against the permissible range of superheat preprogrammed into the controller 100. If the current degree of superheat is below the permissible range, at block 404, the system controller 100 will modulate the solenoid valve 72 open to drain refrigerant from the refrigerant circuit into the charge tank 70. If the current degree of superheat is above the permissible range, at block 405, the system controller 100 will modulate the solenoid valve 74 open to drain refrigerant from the charge tank 70 into the refrigerant circuit. If the degree of superheat falls within the permissible range of superheat, the system controller proceeds to block 406.

If operating in a mode without fixed expansion, the system controller, at block 407, compares the current degree of subcooling against a permissible range of subcooling programmed into the controller. If the current degree of subcooling is above the permissible range, at block 404, the system controller 100 will modulate the solenoid valve 72 open to drain refrigerant from the refrigerant circuit into the charge tank 70. If the current degree of subcooling is below the permissible range, at block 405, the system controller 100 will modulate the solenoid valve 74 open to drain refrigerant from the charge tank 70 into the refrigerant circuit. If the degree of subcooling falls within the permissible range of subcooling, the system controller proceeds to control refrigerant charge through the charge control procedure and the discharge temperature limit control procedure as described.

The various control parameters presented as examples hereinbefore, such as compressor discharge temperature limit, the various time delays, the desired superheat ranges, the desired subcooling ranges, are for a typical 5 ton capacity, split-system heat pump system having a brazed plate water to refrigerant heat exchanger 60, a refrigerant reservoir (charge tank) 70 having a liquid refrigerant storage capacity of 4 kilograms, a system refrigerant charge of 8 kilograms, and overall refrigerant lines of 7 meters. These parameters are presented for purposes of illustration and those skilled in the art will understand that these parameters may vary from the examples presented for different heat pump configurations and capacities. Those having ordinary skill in the art will select precise parameters to be used in implementing the invention to best suit operation of any particular heat pump system.

While the present invention has been particularly shown and described with reference to the preferred mode as illustrated in the drawing, it will be understood by one skilled in the art that various changes in detail may be effected therein without departing from the spirit and scope of the invention as defined by the claims.

The invention claimed is:

1. A refrigerant circuit heat pump system operable in at least an air cooling mode and an air heating air mode and having liquid heating capability comprising:

a refrigerant compressor having a suction port and a discharge port;

a selectively positionable reversing valve having a first port, a second port, a third port and a fourth port, said reversing valve being positionable in a first position for coupling the first port and the second port in fluid flow communication and the third port and the fourth port in fluid flow communication, said reversing valve being positionable in a second position for coupling the first port and the third port in fluid flow communication and the second port and the fourth port in fluid flow communication;

a refrigerant circuit providing a closed loop refrigerant circulation flow path, said refrigerant circuit having a first refrigerant line establishing a flow path between the discharge port of said compressor and the first port of said reversing valve, a second refrigerant line establishing a flow path between the second port of said reversing valve and the third port of said reversing valve, and a third refrigerant line establishing a flow path between the fourth port of said reversing valve and the suction port of said compressor; an outdoor heat exchanger operatively associated with the second refrigerant line and adapted for passing refrigerant passing through the second refrigerant line in heat exchange relationship with ambient air;

an indoor heat exchanger operatively associated with the second refrigerant line and adapted for passing refrigerant passing through the second refrigerant line in heat exchange relationship with the air from the comfort zone, said indoor heat exchanger disposed downstream of said outdoor exchanger with respect to refrigerant flow in the air cooling mode and upstream of the outdoor heat exchanger with respect to refrigerant flow through the second refrigerant line in the air heating mode;

a refrigerant to liquid heat exchanger operatively associated with the first refrigerant line and adapted for passing refrigerant passing through the first refrigerant line in heat exchange relationship with a liquid;

a refrigerant reservoir having an inlet coupled in fluid flow communication to said second refrigerant line at a location intermediate said outdoor heat exchanger and said indoor heat exchanger and an outlet line coupled in fluid flow communication to said third refrigerant line, the outlet line bypassing the refrigerant to liquid heat exchanger;

a first flow control valve operatively associated with said refrigerant reservoir for controlling the flow refrigerant from the second refrigerant line to the inlet of said refrigerant reservoir, said first control valve having an open position and a closed position;

a second flow control valve operatively associated with said refrigerant reservoir for controlling the flow refrigerant between the outlet of said refrigerant reservoir and the third refrigerant line, said second control valve having an open position and a closed position;

and a controller operatively associated with said first and second flow control valves, said controller operative to selectively control the respective positioning of said first and second flow control valves between their respective open and closed positions so as to selectively control the refrigerant charge within the refrigerant circuit.

2. The heat pump system as recited in claim 1 wherein said first and second flow control valves comprise valves having at least one partially open position between their respective open and closed positions; and said controller is further operative to selectively modulate the respective positioning of said first and second flow control valves between open position, at least one partially open position and closed position.

3. The heat pump system as recited in claim 2 wherein said first and second flow control valves comprise pulse width modulated solenoid valves.

4. The heat pump system as recited in claim 1 further comprising a liquid level sensor operatively associated with said refrigerant reservoir, said liquid level sensor operative to sense the level of liquid refrigerant in said refrigerant reservoir and provide a signal indicative of the liquid level within said refrigerant reservoir to said controller.

5. The heat pump system as recited in claim 4 wherein said controller is operative to selectively control the respective positioning of said first and second flow control valves between their respective open and closed positions so as to selectively control the refrigerant charge within the refrigerant circuit in response to the liquid level signal received from said liquid level sensor.

6. The heat pump system as recited in claim 1 further comprising:

a first expansion valve disposed in said second refrigerant line intermediate said outdoor heat exchanger and the location the inlet of said refrigerant reservoir is coupled in fluid flow communication with said second refrigerant line;

a second expansion valve disposed in said second refrigerant line intermediate said indoor heat exchanger and the location the inlet of said refrigerant reservoir is coupled in fluid flow communication with said second refrigerant line;

said first expansion valve being operatively associated with said indoor heat exchanger and said second expansion valve being operatively associated with said outdoor heat exchanger.

7. The heat pump system as recited in claim 1 further comprising:

a first expansion valve bypass line operatively associated with said second refrigerant line for bypassing refrigerant passing through said second refrigerant line in a direction from said outdoor heat exchanger to said indoor heat exchanger around said first expansion valve and through said second expansion valve.

8. The heat pump system as recited in claim 1 further comprising:

a second expansion valve bypass line operatively associated with said second refrigerant line for bypassing refrigerant passing through said second refrigerant line in a direction from said indoor heat exchanger to said outdoor heat exchanger around said second expansion valve and through said first expansion valve.

9. A refrigerant circuit heat pump system operable in at least an air cooling mode and an air heating air mode and having liquid heating capability comprising: a refrigerant compressor having a suction port and a discharge port;

a first selectively positionable valve having a first port, a second port, a third port and a fourth port, said reversing valve being positionable in a first position for coupling the first port and the second port in fluid flow communication and the third port and the fourth port in fluid flow communication, said reversing valve being positionable in a second position for coupling the first port and the third port in fluid flow communication and the second port and the fourth port in fluid flow communication;

a refrigerant circuit providing a closed loop refrigerant circulation flow path, said refrigerant circuit having a first refrigerant line establishing a flow path between the discharge port of said compressor and the first port of said first selectively positionable valve, a second refrigerant line establishing a flow path between the second port of said first selectively positionable valve and the third port of said selectively positionable valve, and a third refrigerant line establishing a flow path between the fourth port of said selectively positionable valve and the suction port of said compressor;

an outdoor heat exchanger operatively associated with the second refrigerant line and adapted for passing refrigerant passing through the second refrigerant line in heat exchange relationship with ambient air;

an indoor heat exchanger operatively associated with the second refrigerant line and adapted for passing refrigerant passing through the second refrigerant line in heat exchange relationship with the air from the comfort zone, said indoor heat exchanger disposed downstream of said outdoor exchanger with respect to refrigerant flow in the air cooling mode and upstream of the outdoor heat exchanger with respect to refrigerant flow through the second refrigerant line in the air heating mode;

a refrigerant to liquid heat exchanger operatively associated with the first refrigerant line and adapted for passing refrigerant passing through the first refrigerant line in heat exchange relationship with a liquid;

a second selectively positionable valve having a first port, a second port, a third port and a fourth port, said second selectively positionable valve being positionable in a first position for coupling the first port and the second port in fluid flow communication and the third port and the fourth port in fluid flow communication, said second selectively positionable valve being positionable in a second position for coupling the first port and the third port in fluid flow communication and the second port and the fourth port in fluid flow communication, said second selectively positionable valve being disposed in said second refrigerant line with the first port in flow communication with said indoor heat exchanger and the second port in flow communication with the third port of said first selectively positionable valve;

a refrigerant reservoir having an inlet coupled by a fourth refrigerant line in fluid flow communication to said second refrigerant line at a location intermediate said outdoor heat exchanger and said indoor heat exchanger and an outlet coupled by a fifth refrigerant line in direct fluid flow communication to said third refrigerant line; and a bypass bleed flow circuit having a first bleed line coupled in flow communication between said fifth refrigerant line and the third port of said second selectively positionable valve and a second bleed line coupled in flow communication between said indoor heat exchanger and the fourth port of said second selectively positionable valve.

10. The heat pump system as recited in claim 9 further comprising:

a first flow control valve operatively associated with said refrigerant reservoir for controlling the flow refrigerant from the second refrigerant line to the inlet of said refrigerant reservoir, said first control valve having an open position and a closed position;

a second flow control valve operatively associated with said refrigerant reservoir for controlling the flow refrigerant between the outlet of said refrigerant reservoir and the third refrigerant line, said second control valve having an open position and a closed position;

and a controller operatively associated with said first and second flow control valves, said controller operative to selectively control the respective positioning of said first and second flow control valves between their respective open and closed positions so as to selectively control the refrigerant charge within the refrigerant circuit.

11. The heat pump system as recited in claim 10 wherein said first and second flow control valves comprise valves having at least one partially open position between their respective open and closed positions; and said controller is further operative to selectively modulate the respective positioning of said first and second flow control valves between their open, at one partially open and closed positions.

12. The heat pump system as recited in claim 11 wherein said first and second flow control valves comprise pulse width modulated solenoid valves.

13. The heat pump system as recited in claim 10 further comprising a liquid level sensor operatively associated with said refrigerant reservoir, said liquid level sensor operative to sense the level of liquid refrigerant in said refrigerant reservoir and provide a signal indicative of the liquid level within said refrigerant reservoir to said controller.

14. The heat pump system as recited in claim 13 wherein said controller is operative to selectively control the respective positioning of said first and second flow control valves between their respective open and closed positions so as to selectively control the refrigerant charge within the refrigerant circuit in response to the liquid level signal received from said liquid level sensor.

15. The heat pump system as recited in claim 9 further comprising:

a first expansion valve disposed in said second refrigerant line intermediate said outdoor heat exchanger and the location the inlet of said refrigerant reservoir is coupled in fluid flow communication with said second refrigerant line;

a second expansion valve disposed in said second refrigerant line intermediate said indoor heat exchanger and the location the inlet of said refrigerant reservoir is coupled in fluid flow communication with said second refrigerant line;

said first expansion valve being operatively associated with said indoor heat exchanger and said second expansion valve being operatively associated with said outdoor heat exchanger.

16. The heat pump system as recited in claim 9 further comprising:

a first expansion valve bypass line operatively associated with said second refrigerant line for bypassing refrigerant passing through said second refrigerant line in a direction from said outdoor heat exchanger to said indoor heat exchanger around said first expansion valve and through said second expansion valve.

17. The heat pump system as recited in claim 9 further comprising:

a second expansion valve bypass line operatively associated with said second refrigerant line for bypassing refrigerant passing through said second refrigerant line in a direction from said indoor heat exchanger to said outdoor heat exchanger around said second expansion valve and through said first expansion valve.

* * * * *